US008674266B2

(12) United States Patent
Fis-Menache

(10) Patent No.: US 8,674,266 B2
(45) Date of Patent: Mar. 18, 2014

(54) HEATER COVERS AND METHODS OF USING THE SAME

(75) Inventor: Arturo A. Fis-Menache, Los Angeles, CA (US)

(73) Assignee: FIS Design, LLC, Los Angeles, CA (US)

( * ) Notice: Subject to any disclaimer, the term of this patent is extended or adjusted under 35 U.S.C. 154(b) by 1298 days.

(21) Appl. No.: 12/197,152

(22) Filed: Aug. 22, 2008

(65) Prior Publication Data

US 2009/0050615 A1 Feb. 26, 2009

Related U.S. Application Data

(60) Provisional application No. 60/968,019, filed on Aug. 24, 2007.

(51) Int. Cl.
*H05B 1/00* (2006.01)

(52) U.S. Cl.
USPC ..... 219/209; 392/407; 126/92 AC; 126/92 A; 126/92 C

(58) Field of Classification Search
USPC ..... 219/200, 201, 209; 392/407; D23/336, D23/339, 342, 395; 126/92 AC, 92 A, 92 B; 150/158, 165
See application file for complete search history.

(56) References Cited

U.S. PATENT DOCUMENTS

| | | | | |
|---|---|---|---|---|
| 1,395,485 | A | | 11/1921 | Duncan et al. |
| D177,469 | S | | 4/1956 | Greenspan |
| D184,614 | S | | 3/1959 | Gennaro |
| 3,222,819 | A | | 12/1965 | Marcan |
| 3,490,469 | A | * | 1/1970 | Dubinsky ..... 135/34.2 |
| 3,788,372 | A | | 1/1974 | Terenzoni |
| D247,166 | S | | 2/1978 | Harshman et al. |
| D293,992 | S | | 2/1988 | Pomroy |
| D319,183 | S | | 8/1991 | Halm |
| 5,050,654 | A | * | 9/1991 | Howell et al. ..... 150/158 |
| D322,558 | S | | 12/1991 | Halm et al. |
| D325,963 | S | | 5/1992 | Anderson |
| 5,240,752 | A | | 8/1993 | Baghsarian |
| D345,848 | S | | 4/1994 | May et al. |
| 5,662,412 | A | * | 9/1997 | Glendmyer ..... 362/351 |
| D388,508 | S | | 12/1997 | Hsiao |
| D388,509 | S | | 12/1997 | Hsiao |
| 5,694,866 | A | * | 12/1997 | Muller ..... 108/161 |
| 5,887,530 | A | * | 3/1999 | Muller ..... 108/90 |

(Continued)

FOREIGN PATENT DOCUMENTS

| | | |
|---|---|---|
| WO | WO 93/00840 | 1/1993 |
| WO | WO 2009/029537 | 3/2009 |

OTHER PUBLICATIONS

PCT Patent Application No. PCT/US2008/074085 filed Aug. 22, 2008 in the name of Fis-Menache, Search Report and Written Opinion mailed Nov. 13, 2008.

*Primary Examiner* — Dana Ross
*Assistant Examiner* — John Wasaff
(74) *Attorney, Agent, or Firm* — Levine Bagade Han LLP

(57) ABSTRACT

Heater covers and methods of using the same are disclosed. The covers can be used on stand-type movable or fixed patio heaters or table top heaters. The covers can be removably attached to the heaters. The covers can have body covers separate or attached to head covers. The covers can be resilient or rigid. The rigid covers can have hinges and can clamshell or telescope around the heaters.

26 Claims, 44 Drawing Sheets

(56) References Cited

U.S. PATENT DOCUMENTS

| | | | | |
|---|---|---|---|---|
| 5,964,233 | A | 10/1999 | Clark et al. | |
| D420,440 | S | 2/2000 | El-Assir | |
| D424,471 | S | 5/2000 | Souris | |
| D429,324 | S * | 8/2000 | Olson et al. | D23/342 |
| D434,842 | S | 12/2000 | Thomas et al. | |
| 6,217,199 | B1 | 4/2001 | Lo et al. | |
| 6,286,266 | B1 | 9/2001 | Popowych et al. | |
| D450,816 | S | 11/2001 | Bilotti | |
| 6,336,450 | B1 | 1/2002 | Collet | |
| D456,498 | S | 4/2002 | Jeng | |
| D457,936 | S * | 5/2002 | Garofalo et al. | D23/206 |
| 6,422,232 | B1 | 7/2002 | Ashton et al. | |
| D462,558 | S * | 9/2002 | Friedman | D6/610 |
| 6,470,877 | B1 | 10/2002 | Waters | |
| D466,993 | S | 12/2002 | Chang | |
| D470,212 | S | 2/2003 | Cardwell, III et al. | |
| D470,232 | S | 2/2003 | Yeh | |
| D470,932 | S | 2/2003 | Smith et al. | |
| D471,622 | S | 3/2003 | Bossler | |
| D472,623 | S | 4/2003 | Bossler | |
| 6,651,647 | B2 | 11/2003 | Waters | |
| 6,668,818 | B2 * | 12/2003 | Bossler | 126/92 AC |
| D486,211 | S | 2/2004 | Chan et al. | |
| D486,567 | S | 2/2004 | Sakai | |
| D487,588 | S | 3/2004 | Millan | |
| D489,125 | S | 4/2004 | Drake | |
| 6,745,759 | B2 | 6/2004 | Bossler | |
| 6,907,875 | B1 * | 6/2005 | Eastman, II et al. | 126/92 B |
| D537,154 | S | 2/2007 | Cunningham et al. | |
| D542,707 | S | 5/2007 | Kolokotronis et al. | |
| D543,610 | S | 5/2007 | Catron | |
| D574,076 | S | 7/2008 | Baraky | |
| D581,035 | S | 11/2008 | Conway et al. | |
| D593,191 | S | 5/2009 | Walker | |
| D599,899 | S | 9/2009 | Thompson | |
| D602,396 | S | 10/2009 | Conway et al. | |
| D631,149 | S | 1/2011 | Fis-Menache | |
| 2004/0011346 | A1 | 1/2004 | Sakai | |
| 2004/0033461 | A1 | 2/2004 | Hart et al. | |
| 2006/0090784 | A1 | 5/2006 | Ma | |

* cited by examiner

NOT INVENTION

NOT INVENTION

NOT INVENTION

HEATER COVERS AND METHODS OF USING THE SAME

CROSS-REFERENCE TO RELATED APPLICATION

This application claims priority to U.S. Provisional Application No. 60/968,019, filed Aug. 24, 2007, which is herein incorporated by reference in its entirety.

BACKGROUND OF THE INVENTION

1. Field of the Invention

This invention relates to covers for heaters, such as stand-type gas or electric heaters, and methods of using the same. The heater can be, for example, a movable or fixed patio heater or table-top heater.

2. Description of Related Art

Typical tower heaters, such as those used for outdoor and patio use, have an appearance that is considered "industrial" and sterile by many. Some newer designs for tower heaters obstruct the typical "industrial" design, for example, providing the tower heater with the configuration of a palm tree, or other design. These alternate designs are permanently fixed to the heater. However, it is often desired to change the design of the heater without having to have separate heaters for each design or without having to incur the expense to purchase a new standup heater to change the design.

Tower heaters (e.g., patio heaters) are often used in public, residential, and commercial locales. For example, tower heaters are often located in outdoor seating areas at restaurants, in plazas, and outdoor malls; or by event planners or rental companies for functions or parties. These locations make the heaters optimum sites for advertising. However, the towers are often too thin and the heat shields of the heaters are too steep of an angle and its surface too hot to reasonably display advertising. The base is also well below eye level, so posting advertising on the base would be generally out of sight.

Therefore, replaceable and/or removable outer configuration for tower heaters is desired. Furthermore, a configuration of a heater and accompanying method for reasonably attaching a display to a tower heater is desired.

SUMMARY OF THE INVENTION

A device for camouflaging the mechanical structure of a tower (e.g., patio, outdoor) heater is disclosed. The device can be a cover or shell. The cover can have an assembly of, for example, two to four panels or "skins" or cover sections. The cover sections can be rigid or flexible. The cover sections can be rotatably attached to each other, for example via one or more rotatable hinges. The cover sections can be attached to the underlying mechanical structure of the tower heater in a "clamshell" fashion.

The cover can be constructed from one or more elements that extend longitudinally along the entire cover, or horizontally with the split occurring somewhere around the base and tower, or the cover can be made from a body cover and/or separate head cover. The body cover can have a tower cover and a separate base cover. The head cover can be a decorative "shade" or shield around the existing parabolic heat deflector (i.e., heat shield or heater head) at the top of the heater structure.

The head cover can have a cylindrical or a conical, square, polygonal, elliptical, hemispherical configuration or a partial configuration of any of the aforementioned configurations, or a combination of any of the configurations thereof. If the head cover has a conical or partial conical configuration, the angle of the cone with respect to the longitudinal axis of the heater can be from about 0° to about 45°+/− in either direction, more narrowly from about 0° to about 25° in either direction.

One or more displays can be attached to the heater head, tower, body, base, head cover, tower cover, base cover, body cover, or combinations thereof. The displays can have a flat or curved surface. The displays can form an angle with the longitudinal axis of the heater from about 0° to about 45°+/− in either direction, more narrowly from about 0° to about 25° in either direction.

The cover can be made from one or more rigid or semi rigid materials, for example thermoplastics (e.g., Polyethylene terephthalate (PET), Polyethylene (PE), Polypropylene (PP)), polycarbonates, or silicon or vinyl-base materials or EVA copolymers which may, for example, be blow, injection, or rotational molded, fiberglass reinforced polymers ("FRP" or fiberglass), resins, stamped or spun sheet metal, urethane over a formed metal structure, heat resistant fabrics stretched around a metal frame, or combinations thereof in smooth or textured finish. The material can be opaque, translucent or transparent. The cover can be made from materials that can be lightweight, suited for outdoor use, long lasting, and have a durable finish in multiple colors. The cover can be made by being molded, for example roto-molded.

The cover sections can be attached to and detached from each other with mechanical hardware, such as one or more fasteners including quick release fasteners 70, one or more piece of hook and loop tape (e.g., Velcro); one or more piece of interlocking stem and head tape (e.g., Dual Lock from 3M Corporation of Minneapolis, Minn.), magnets, latches, clips, ties, hooks, locking pins, the ports and flanges to which they are to attach, and combinations thereof, for example applied on overlapping flanges (e.g., tongue-and-groove, guide-pins, grooves) or into ports of adjacent cover sections. The fasteners 70 can be locked, hooked, pressed, snapped or otherwise joined together into place.

The cover sections can be hinged together, for example in a clamshell fashion.

The cover sections can have horizontal seams. The horizontal seams can divide the cover sections into two or more section that can telescope or separate when moved relative to each other in a vertical direction. For example, a lower section can slide upwards, and may temporarily come to rest on the tinder structure of the patio heater column to gain access, for example, to the propane tank area, for example to service the propane tank area or replace the propane tank. The cover sections can be simply and repeatedly assembled, disassembled, and easily transported between locations, or stored by nesting the cover sections together.

The covers can have fluting or grooves, textures, appliqués, self-adhesive tape, and combinations thereof. For example, these features (e.g., fluting/grooves, textures, decorative rings, etc.) can hide joints between the cover sections while providing aesthetic design alternatives.

The head cover sections can be punctured, louvered, folded, made of metal mesh, or otherwise treated, for example to dissipate and/or collect and/or direct heat and/or to provide alternate aesthetics.

The head cover sections can be attached to and detached from the tower, head and base of the heater. The head cover sections can have or be attached to straps or spokes. For example, two to four or three to six straps or spokes can radially extend from the center of the heater. The straps or spokes can attach to the cover section (e.g., the head cover or the body cover). Mechanical quick-release fasteners 70 can attach the cover sections to the heater head or body (e.g., tower or base). The fasteners 70 can thermally insulate the cover sections from the heater head or body. The thermal insulators can be spacers and/or a layer of thermal insulating material.

BRIEF DESCRIPTION OF THE DRAWINGS

FIG. 4*p*' illustrates a close-up view of the head of the heater of FIG. 4*p*.

FIG. 4*q*' illustrates a close-up view of the head of the heater of FIG. 4*q*.

FIG. 4*r*' illustrates a close-up view of the head of the heater of FIG. 4*r*.

DETAILED DESCRIPTION

Figure 1:
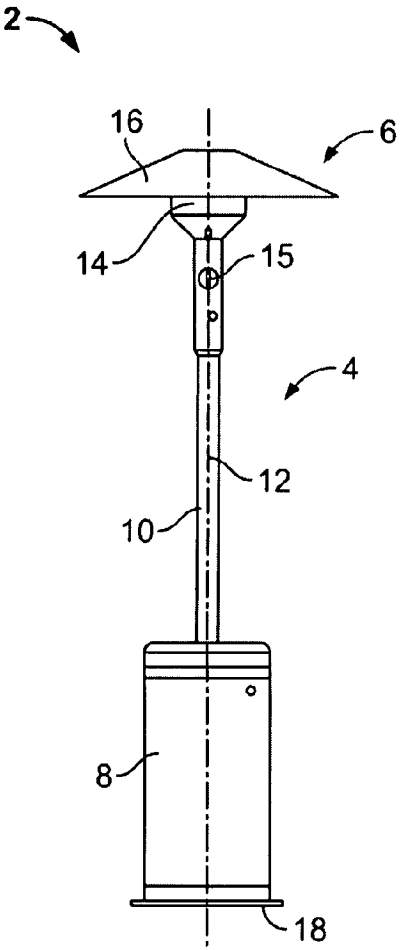
FIG. 1 illustrates a variation of a stand-type tower propane heater, not the invention.

FIG. 1 illustrates that a patio or other outdoor tower heater 2 can have a body 4 and a heater head 6. The body 4 can have a base 8 and a tower 10. The base 8 can hold or otherwise be connected to a fuel source, such as a propane tank or a hose and connection to a natural gas outlet, or a generator (e.g., solar, gas) or electrical outlet (e.g., for an electrical heater). The tower 10 can extend from the base 8 vertically along a longitudinal axis 12. The heater 2 can have a heat emitter 14, for example at the top of the tower 10. The heater 2 can have one or more controls 15, for example, to alter the quantity of heat emitted from the heat emitter 14 and to turn the heat emitter 14 on and off.

The heater 2 can have a heater head 6. The heater head 6 can be attached to or integral with the top of the tower 10. The heater head 6 can have a heat shield 16. The heat shield 16 can extend radially from the longitudinal axis 12. The heat shield 16 can slope downward. The heat emitter 14 can be in the heater head 6 or the body 4, depending on the configuration of the particular heater 2. The heat shield 16 can partially or completely overlap the heat emitter 14 in the longitudinal direction.

The base 8 can have a base ground plate 18 on the bottom of the base 8. The base ground plate 18 can be a stable foundation against the ground. The base 8 can have wheels (not shown), for example to adjust or otherwise alter the location of the heater 2. FIG. 1 is not the invention. The base 8 can house and/or be a propane, butane, methane or other fuel tank. The fuel tank can be connected to a conduit connected, for example through the tower 10, to the heat emitter 14.

Figure 2:
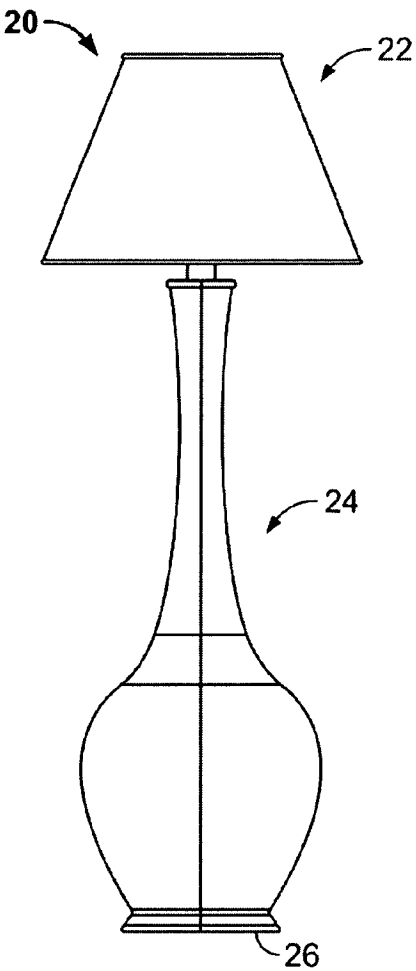
FIG. 2 illustrates a variation of the heater cover.

FIG. 2 illustrates that a heater cover 20 can have a head cover 22 and a body cover 24. The head cover 22 can be attached or detached from the body cover 24. The head cover 22 can be directly attached or detached from the heater head 6 and/or heat shield 16 and/or heat emitter 14. The head cover 22 can partially or completely obscure the head 6 and/or heat shield 16 and/or heat emitter 14 from view of bystanders at various distances and angles to the heater. The head cover 22 can have a completely or partially conical configuration (e.g., a cone with the top cut-off and no base 2). The cover can have a cover ground plate 26 on the bottom of the body cover 24. The cover can have a port in the bottom of the body cover 24 to allow the base 8 and/or base ground plate 18 to exit the body cover 24 and rest on the ground, floor, or other foundation platform.

Figure 3:
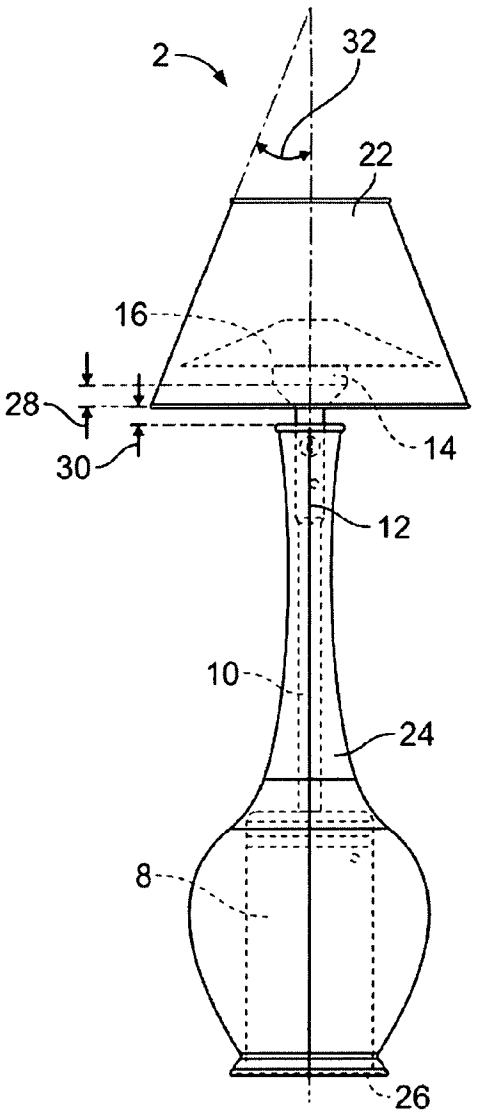
FIG. 3 is a partial see-through view of the heater cover of FIG. 2 attached to the heater of FIG. 1.

FIG. 3 illustrates that the heater cover 20 can substantially cover or otherwise surround the heater 2. The head cover 22 can partially or completely surround the heat shield 16. The head cover 22 can be attached to the heater head 6, the heat shield 16, the tower 10, the body cover 24, or combinations thereof.

The body cover 24 can partially or completely surround the heater body, for example the tower 10 and/or the base 8.

The bottom of the head cover 22 can be lower than the bottom of the heat emitter 14 by a heater cover overhang 28. The heater cover overhang 28 can be from about 15 (−6 in.) (e.g., when the bottom of the head cover 22\is higher than the bottom of the heat emitter 14) to about 30 cm (12 in.), for example about 5 cm (2 in.), or 10 cm (4 in.), or 15 cm (6 in.).

A cover gap 30 can be between the bottom of the head cover 22 and the top of the body cover 24. The cover gap 30 can be from about 30 cm (−12 in.) (e.g., cover overlap) to about 61 cm (24 in.), more narrowly from about 0 cm (0 in.) to about 41 cm (16 in.), for example about 10 cm (4 in.).

The head cover 22 can have a head cover slope 32 angle with respect to the longitudinal axis 12. The head cover slope 32 angle can be from −60° to about 75°, for example about 30° or about 0°. In some variations, the head cover slope 32 angle can be from about −60° to about −10°, more narrowly from about 45° to about −15°, for example about 30°. In other variations, the head cover slope 32 can be from about 0° to about 75°, more narrowly from about 15° to about 60°, for example about 45°.

Figure 4C:
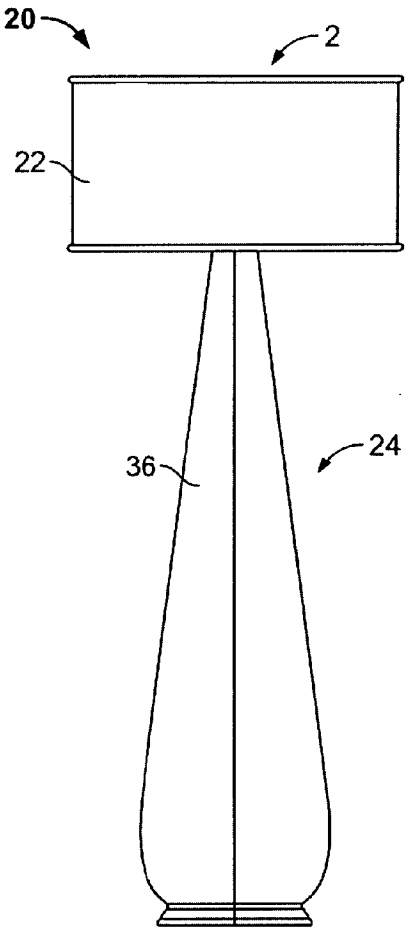
FIGS. 4*a* through 4*p* illustrate the heater with variations of the heater cover.
FIG. 4*q* illustrates the heater with a variation of the heater cover.
FIG. 4*r* illustrates the heater with a variation of the heater cover.
Figure 4B:
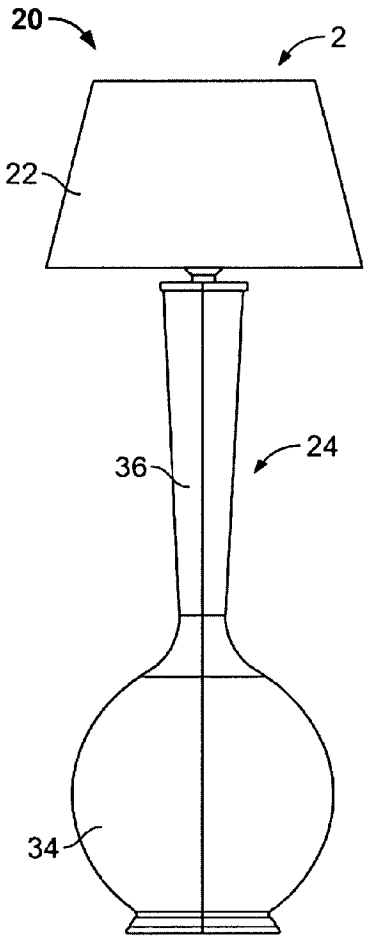
Figure 4A:
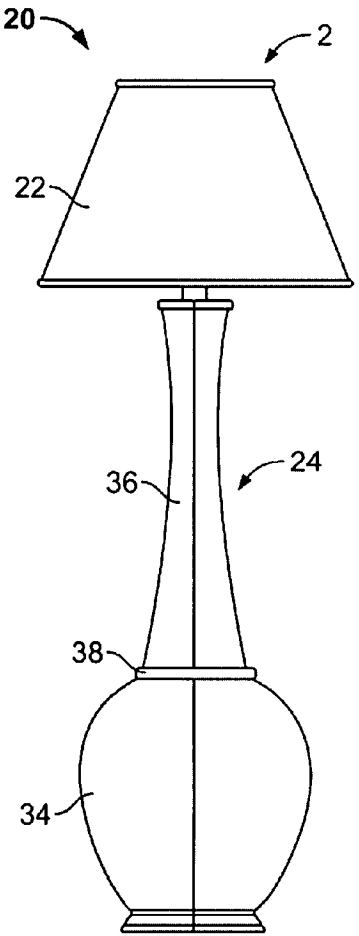

FIG. 4*a* illustrates that the base cover 34 can be fixedly or removably attached to the tower cover 36 at a joint 38. The base cover 34 can be longitudinally asymmetrical and bulbous. The tower cover 36 can be elongated. The base cover 34 can be configured to slide upwards at joint 38 telescoping onto tower cover 36, temporarily made to rest on the under structure of tower 10, for example in order to provide servicing access, for example, to the propane tank of the base 8. For shipping and storage, the cover 36 can slide into the cover 34 in order to reduce the combined volume. The joint 38 can be located higher or lower than shown, for example about 24" to about 37" from the ground. The covers 34 and 36 can each be made in one, two, or more pieces permanently or semi-permanently joined to form each lower or upper cover. The heater cover 20 can be opaque, translucent, transparent, or combinations thereof.

FIG. 4*b* illustrates that the base cover 34 can be integral with the tower cover 36. The base cover 34 can be substantially spherical.

FIG. 4*c* illustrates that the body cover 24 can be configured with a substantially uniform slope with respect to the longitudinal axis 12 from the base 8 to the top of the body cover 24. The head cover 22 can be substantially cylindrical. The cover gap 30 can be zero or negative (e.g., overlap).

Figure 4D:
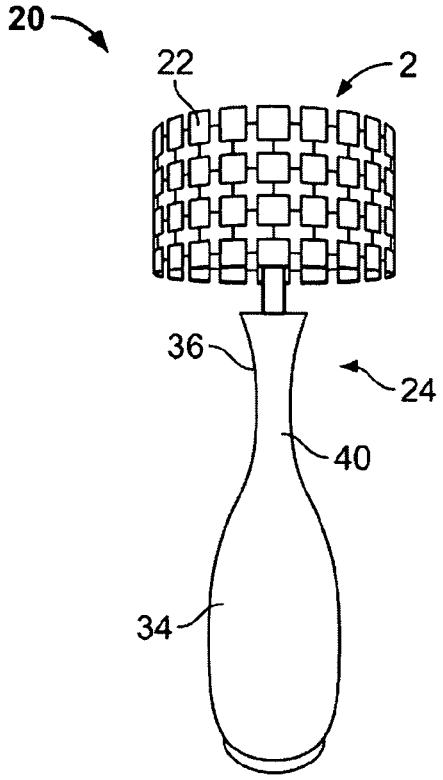

FIG. 4*d* illustrates that the head cover 22 can have a cylindrical configuration. The head cover 22 can be partially opaque (e.g., at the "linked square" design, as shown) and partially translucent (e.g., at the remainder). The body cover 24 can have a pinched neck 40 configuration in the tower cover 36. The pinched neck 40 can serve as a handle to carry or move the heater 2. The pinched neck 40 can be structurally reinforced.

Figure 4E:
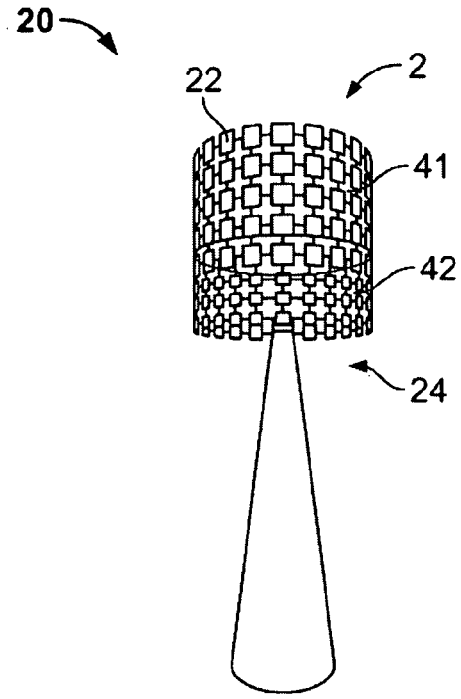

FIG. 4*e* illustrates that the head cover 22 can have a solid backing 41 and links 42. The links 42 can descend below (e.g., hang from) the bottom of the backing 41.

Figure 4F:
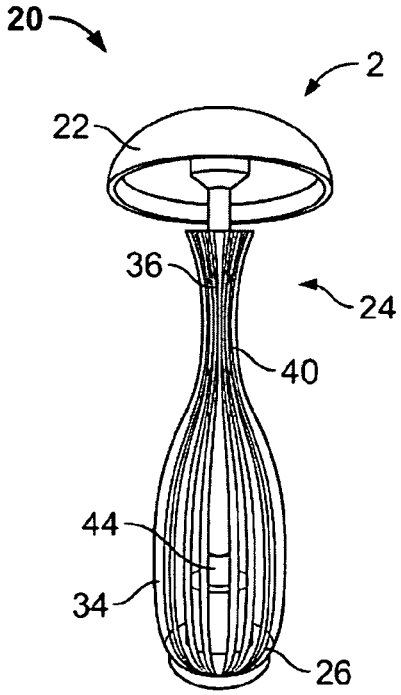

FIG. 4*f* illustrates that the base cover 34 and/or the head cover 22 can be made from numerous beams 44 or rods having a substantially longitudinal alignment. The beams 44 of the body cover 24 can be attached or integral to the cover ground plate 26 or one or more circular reinforcements.

Figure 4G:
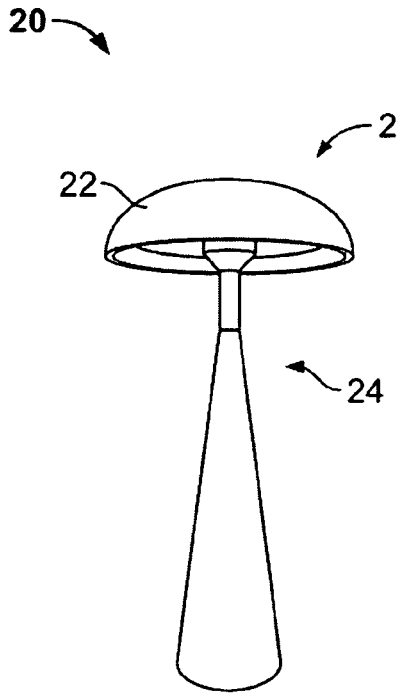
Figure 4H:
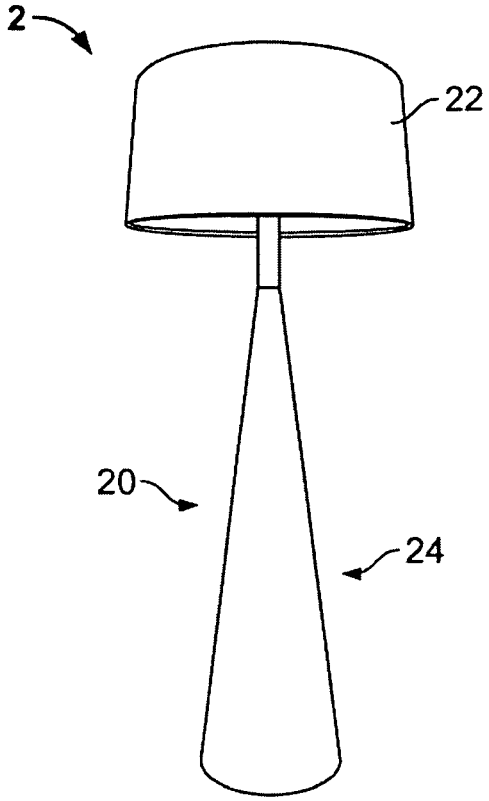

FIGS. 4*f* and 4*g* illustrate the head cover 22 can have a rounded dome or substantially hem-spherical or hemi-ovaloid configuration. The top of the head cover 22 can be opened or closed.

FIGS. 4*e*, 4*g*, 4*h* and 4*j* illustrate that the body cover can have a substantially conical configuration.

Figure 4I:
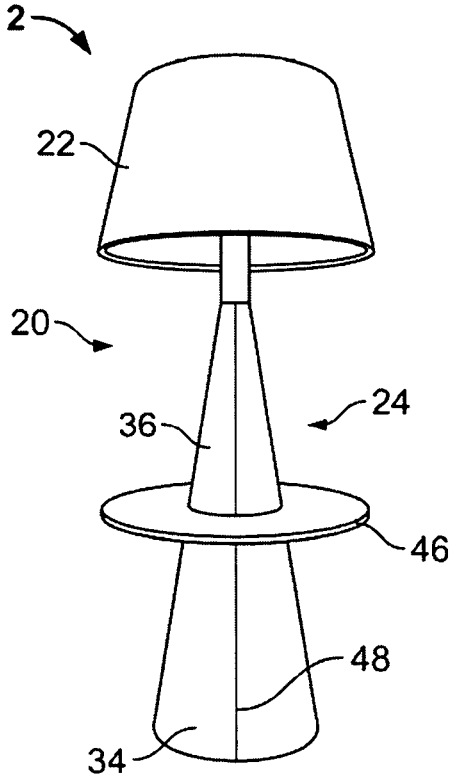
Figure 4J:
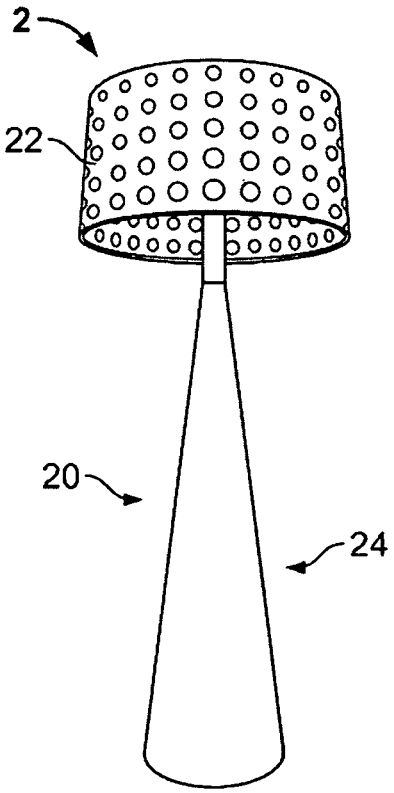

FIG. 4*i* illustrates that the heater cover 20 can have a platform or counter 46, for example, positioned along the tower cover 36, between the tower cover 36 and the base cover 34, along the base cover 34, or on the tower cover 36. The heater cover 20 can have one or more platforms or counters 46. The body cover 24 and/or head cover 22 can have a seam 48 extending partially or completely along the length of the respective body cover 24 and/or head cover 22 in the direction of the longitudinal axis 12.

4*j* illustrates that the head cover 22 and/or body cover 24 can one or more holes, such as circular, square, rectangular, triangular or oval holes, or combinations thereof. The holes can face substantially radially outward from the longitudinal axis 12.

Figure 4K:
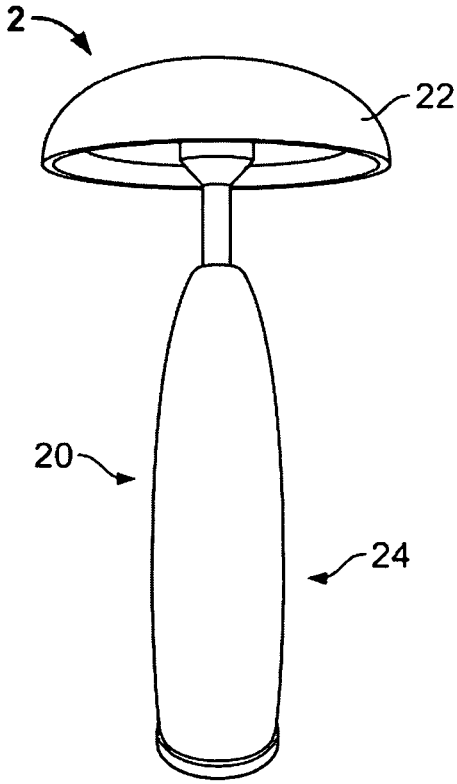

FIG. 4*k* illustrates that the heater cover 20 can have a domed head cover 22. The body cover 24 can have a bulbous conical configuration.

Figure 4L:
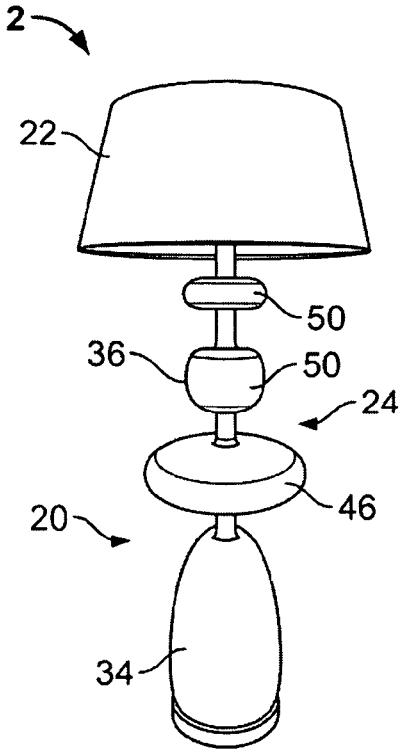

FIG. 4*l* illustrates that one or more radial bulbs 50 can extend from the tower cover 36. The counter 46 can have a rounded top surface and may or may not prove useful to rest loose items on without the loose items rolling off the counter 46. The counter 46 can be a bulb 50, as shown.

Figure 4M:
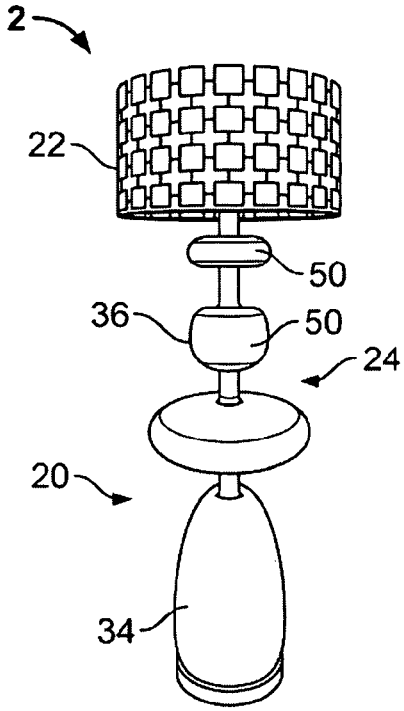
Figure 4N:
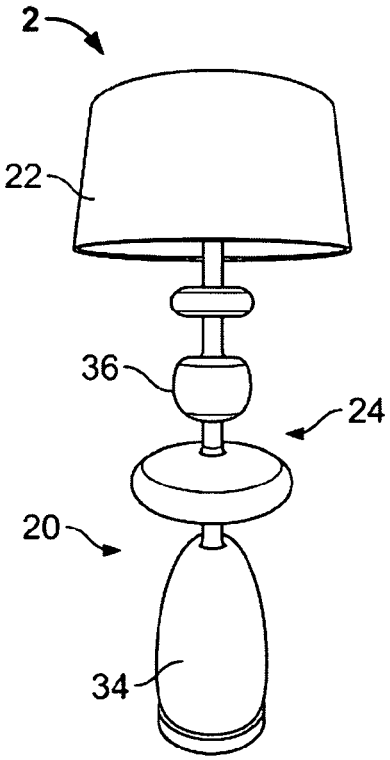
Figure 4O:
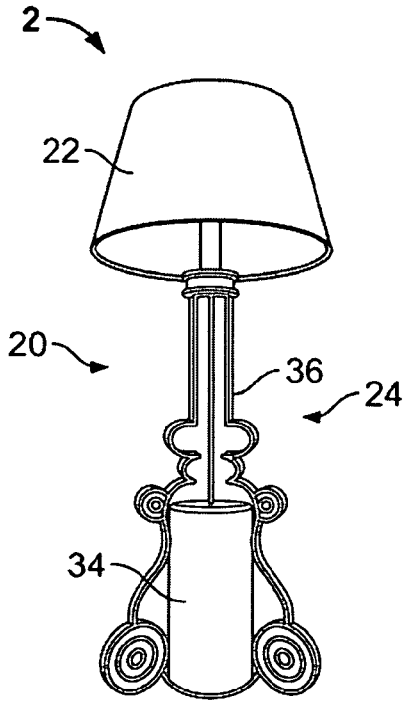

FIGS. 4*l*, 4*n* and 4*o* illustrate head covers 22 with various translucencies. FIG. 4*m* illustrates a body cover 24 that can have numerous bulbs 50 and a cylindrical head cover 22.

Figure 4P:
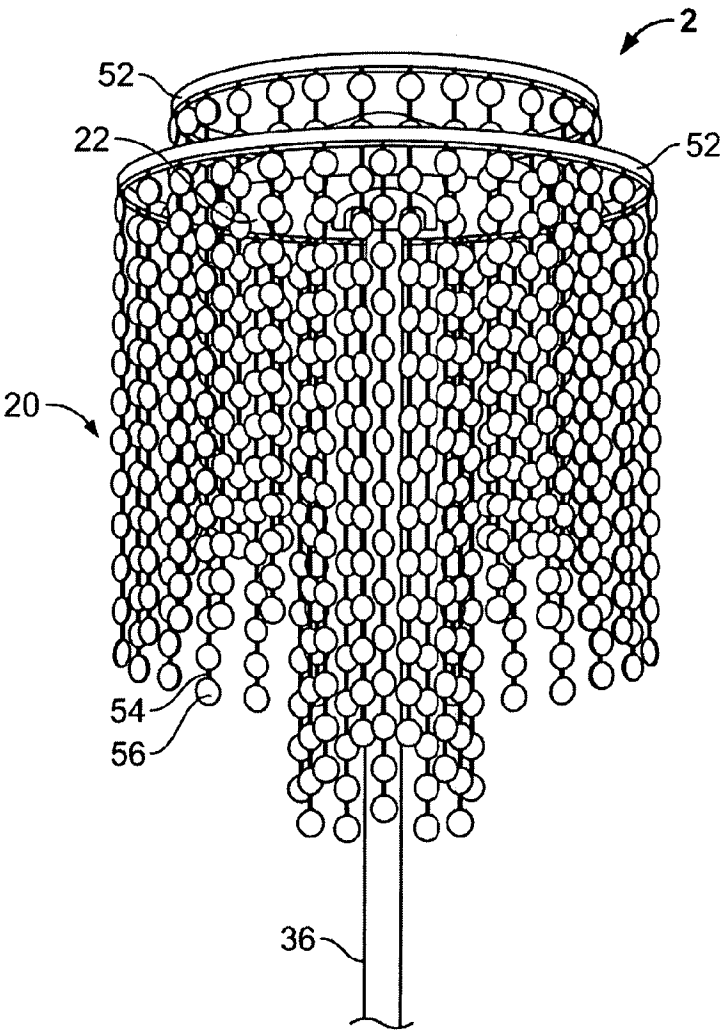
Figure 4P:
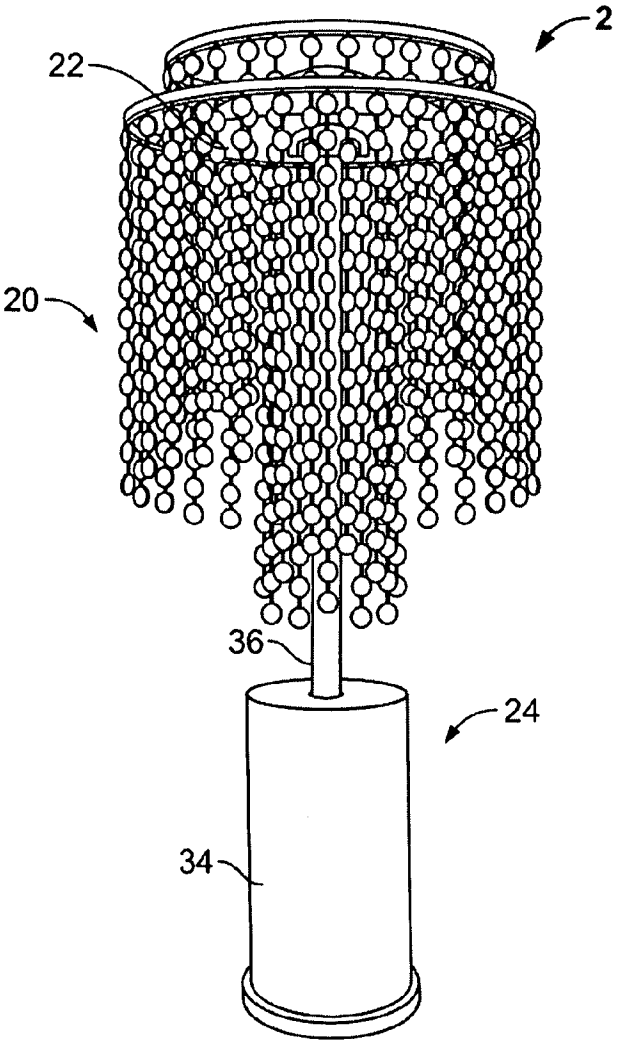

FIGS. 4*p* and 4*p*' illustrates that the head cover 22 or body cover 24 (not shown) can have a chandelier configuration. The head cover 22 can have one or more head cover supports 52, such as circular rigid loops. The head cover 22 can have one or more lines 54 of the same or different lengths hanging from the head cover supports 52. The lines 54 can be thin nylon or metal wires. The lines 54 can each have one or more volumetric elements 58, such as discs 56 or other items, securely attached thereto. The volumetric elements 58 can be metal (e.g., steel or aluminum, wherein the metal can have a raw finish or be powder coated) or plastic, glass, crystal, or combinations thereof. The volumetric elements 58 can cylindrical, circular, pyramidal, spherical, a diamond cut configuration, or combinations thereof.

The tower cover 36 and the base cover 34 can be cylindrical with constant radii along the longitudinal axis 12. The respective radii of the tower cover 36 and the base cover 34 can be equal or different. For example, the tower cover 36 can have a larger or smaller (as shown) radius than the body cover 24.

Figure 4Q:
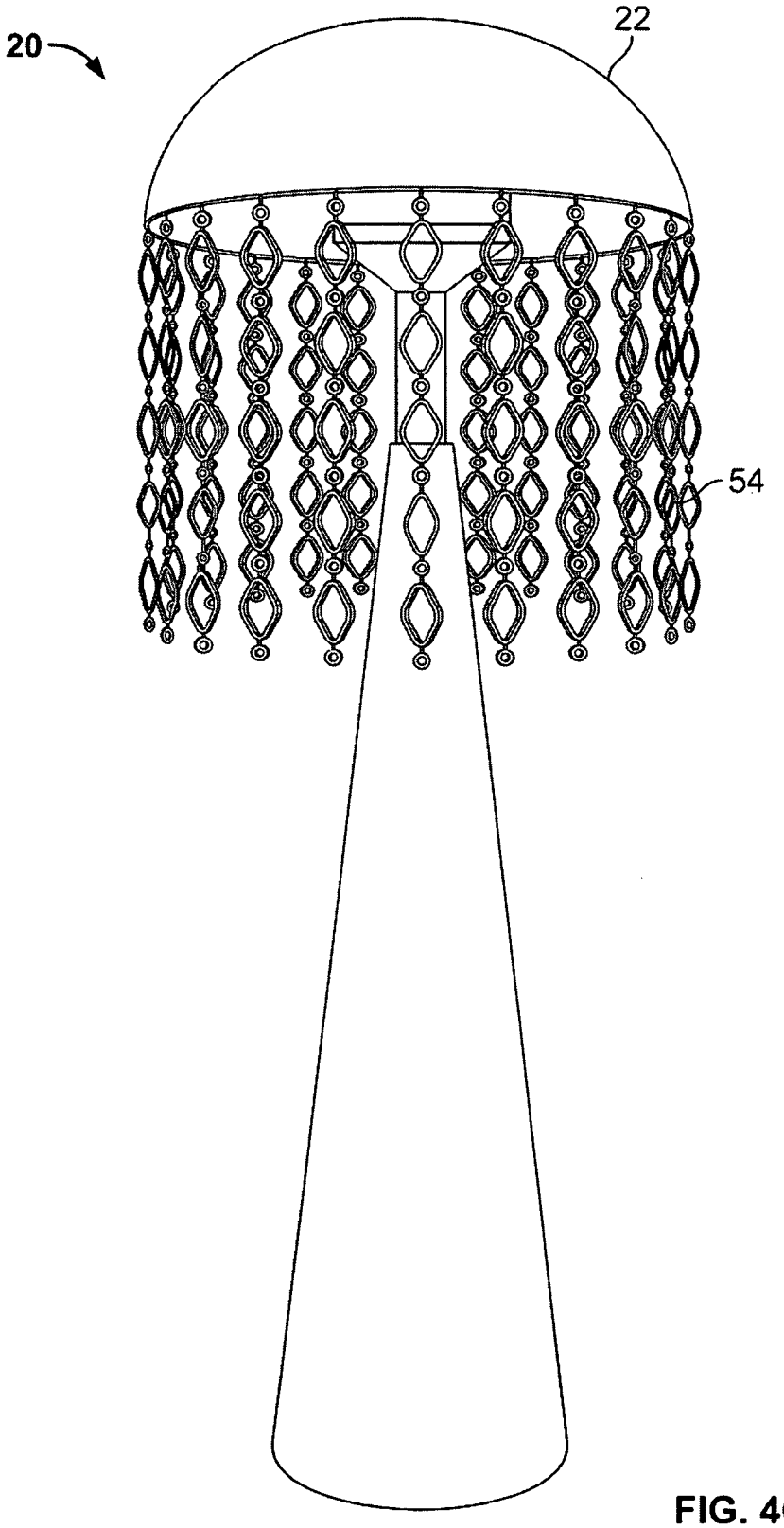
Figure 4Q:
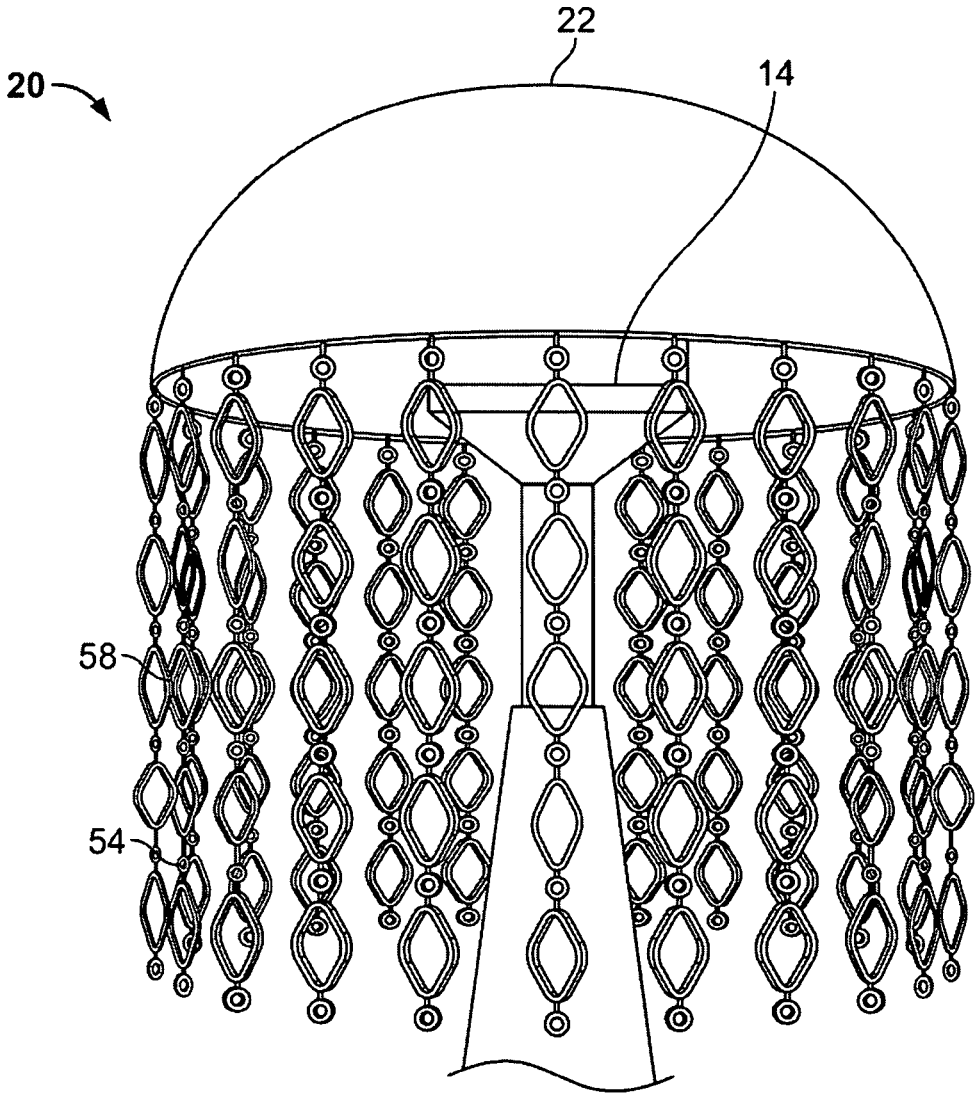

FIGS. 4*q* and 4*q*' illustrate that the head cover 22 or body cover 24 (not shown) can have a curtain configuration. The head cover 22 can have lines 54 hanging from the radial periphery of the head cover 22. The lines 54 can be of the same or different lengths. The lines 54 can have volumetric elements 58, such as discs 56, beads and charms, attached thereto. The lines 54 can be made from the volumetric elements 58 being directly connected to each other (e.g., no wire need be used along the entire length of the line 54) or hanging from wires or nylon threads.

Figure 4R:
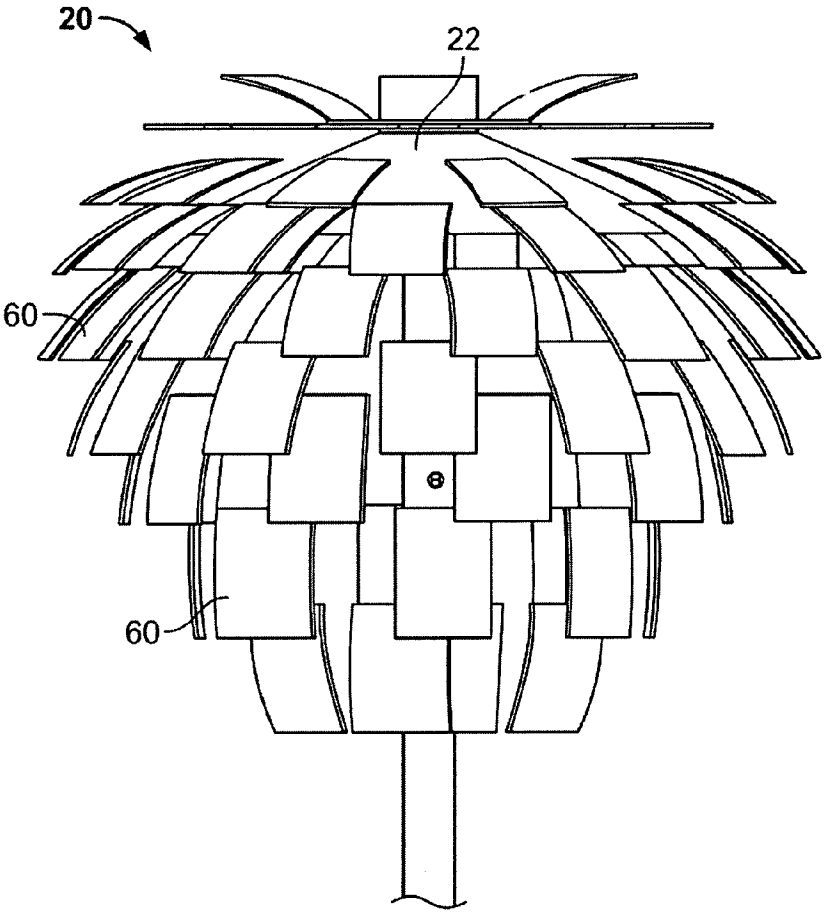
Figure 4R:
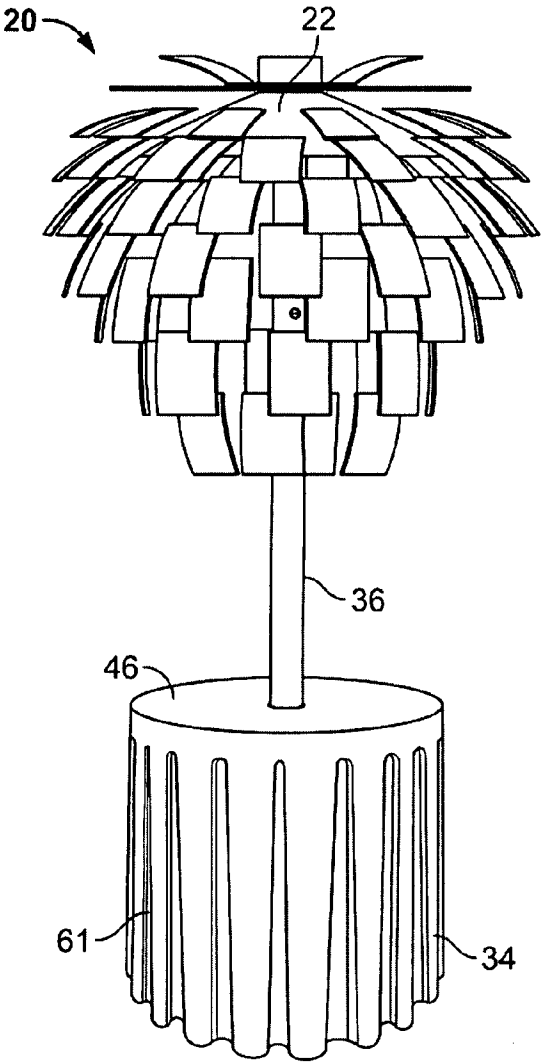

FIGS. 4*r* and 4*r*' illustrate that the head cover 22 and/or body cover 24 can have a tree configuration. The head cover 22 can have leaves 60 extending radially from the longitudinal axis 12. The leaves 60 can be square, circular, rectangular, triangular, oval, or combinations thereof. The leaves 60 can extend directly from the heater head 6 of the heater 2, and/or rigid or resilient branches (obscured in the illustrations by the leaves 60) can extend from the heater head 6 and the leaves 60 can attach to or be integral with the branches.

The top of the base cover 34 can be a counter 46 or platform. The base cover 34, and/or tower cover 36, and/or head cover 22 can be covered with or otherwise attached to fabric or plastic (shown only on the base cover in FIG. 4*r*). For example, the base cover 34 can be fixedly or removably attached to a fabric or plastic tablecloth. The base cover 34 can have slots 61 or grooves and/or the "slots" 61 can be folds in fabric (e.g., the tablecloth) hanging off the side off the counter 46.

Figure 5A:
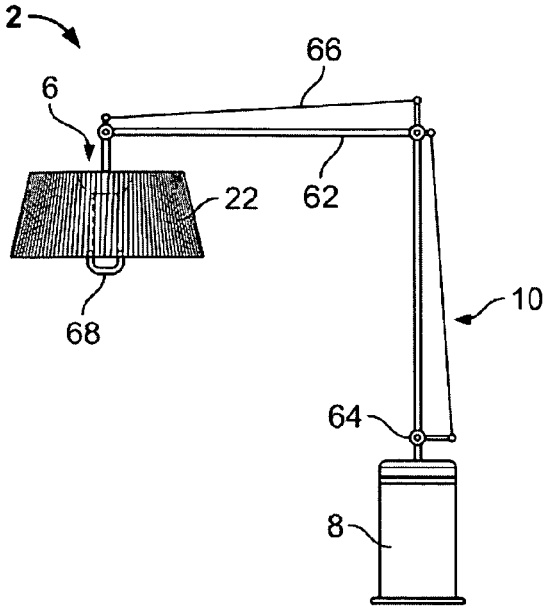
FIGS. 5*a* through 5*c* and 6 illustrate the heater with variations of the heater cover that can be articulated.
Figure 5B:
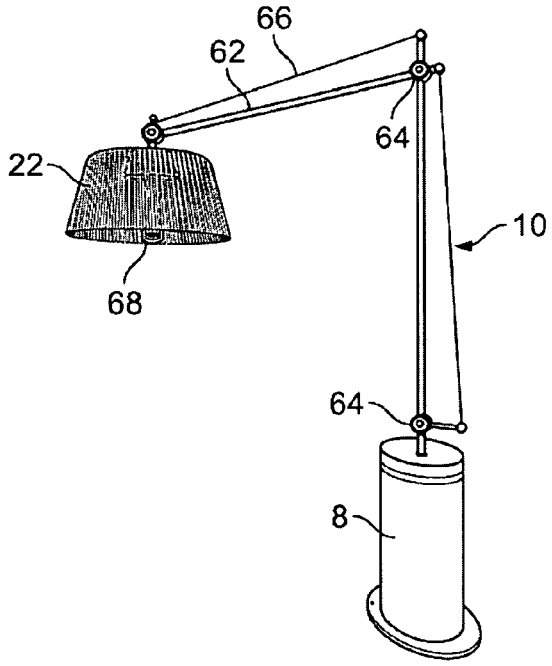
Figure 5C:
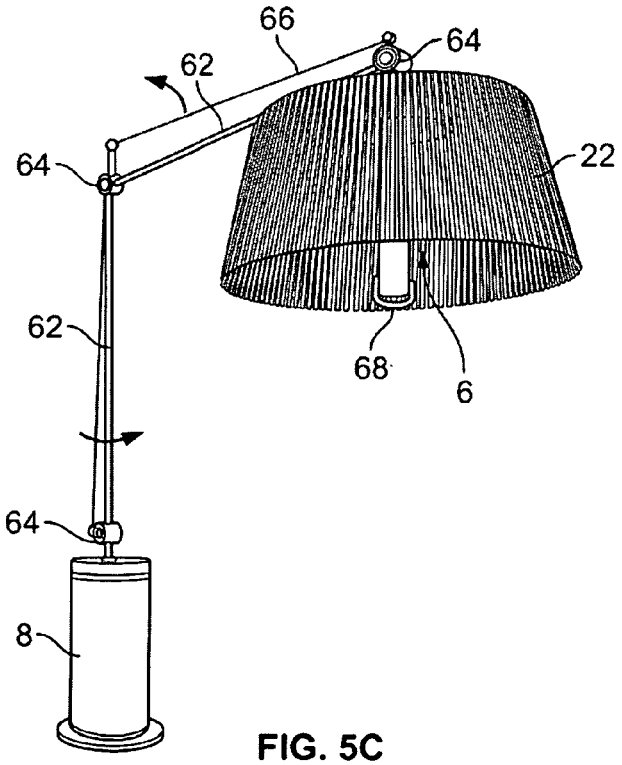

FIGS. 5*a* through 5*c* illustrate that the tower 10 can be articulatable. The tower 10 can have more than one tower linkage 62. The tower linkages 62 can be cantilever beams extending from the tower 10. For example, the heater head 6, optionally with the head cover 22, can be placed over the center of a table, chair or other furniture or location with the tower 10 beside the table, chair, other furniture or location.

Adjacent tower linkages 62 can be attached at fixedly rotatable hinges 64. Adjacent hinges 64 and/or adjacent tower linkages 62 can be attached by tensile cables 66. The tensile cables 66 and/or friction in the hinges 64 can fix the tower 10 in a configuration when the tower 10 is not being adjusted by a user. The heater head 6 can have a thermally insulated and/or removably attached head handle 68.

A flexible fuel or electrical conduit can be inside of the tower linkages 62. The flexible fuel conduit can transport fuel or electricity from the base 8 to the heat emitter 14 in the heater head 6.

FIGS. 5*b* and 5*c* illustrate that the tower linkages 62 can be swiveled or otherwise rotated, as shown by arrows, with respect to each other and/or the base 8 and/or the heater head 6, for example to control the position and angle of the heater head 6 and/or radiative direction of the heat. The position of the heater head 6 can be manipulated vertically (i.e., up and down) and/or horizontally (i.e., side to side), and/or the angular orientation of the heater head 6 can be manipulated.

Figure 6:
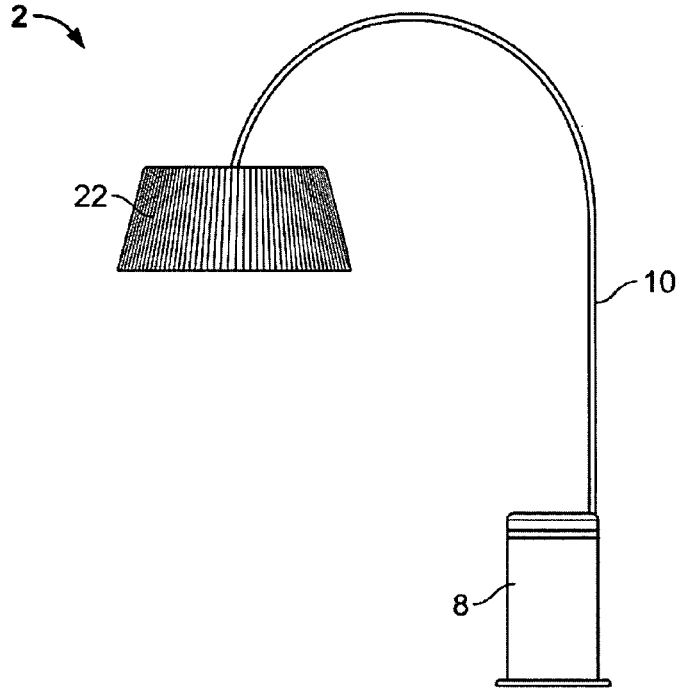

FIGS. 5*a*, 5*b*, 5*c* and 6 illustrate that the tower 10 can be attached to or integral with the top of the heater head 6. FIG. 6 illustrates that the tower 10 can have a hooked, curved, rounded, arcuate, or "J" configuration. The tower 10 can be rigid or deformable. The tower 10 can be attached to the radial center of the base 8 with respect to the longitudinal axis 12 of the base 8 or to a radial side of the base 8, such as on the radial perimeter of the base 8, as shown.

Figure 7:
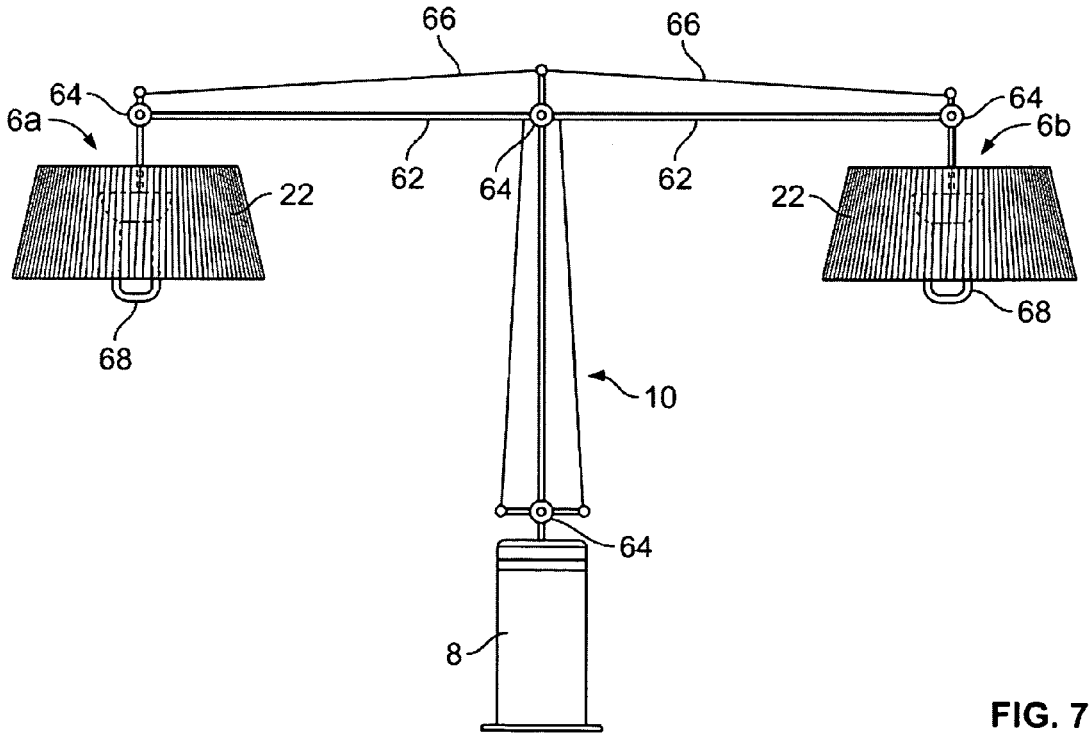
FIGS. 7, 8*a* and 8*b* illustrate variations of the heater with multiple heater heads and variations of the heater cover.

FIG. 7 illustrates that the heater can have two or more heater heads 6*a* and 6*b*. Each heater heads can have an individual heat emitter 14. Each heater head 6 can be attached to its own tower linkage 64, or a tower linkage 64 shared with other heater heads 68. The heater heads 6 can be moved individually or in combination with each other.

Figure 8A:
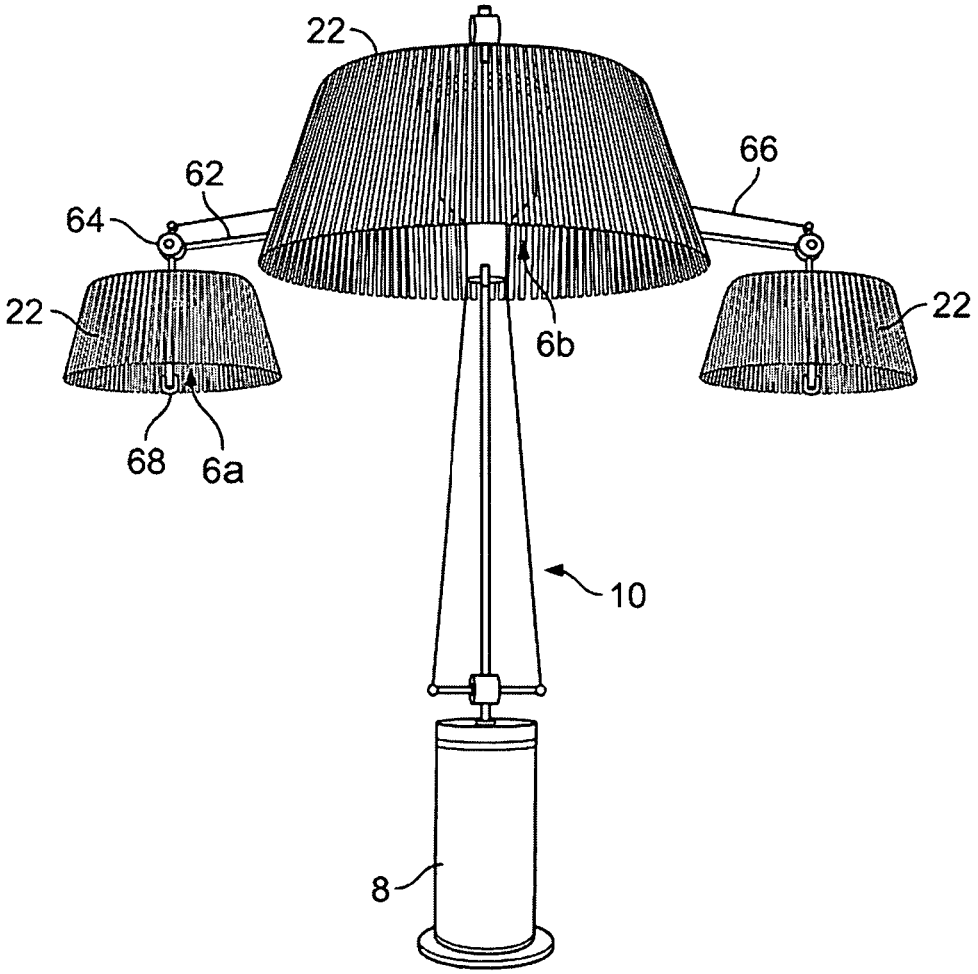
Figure 8B:
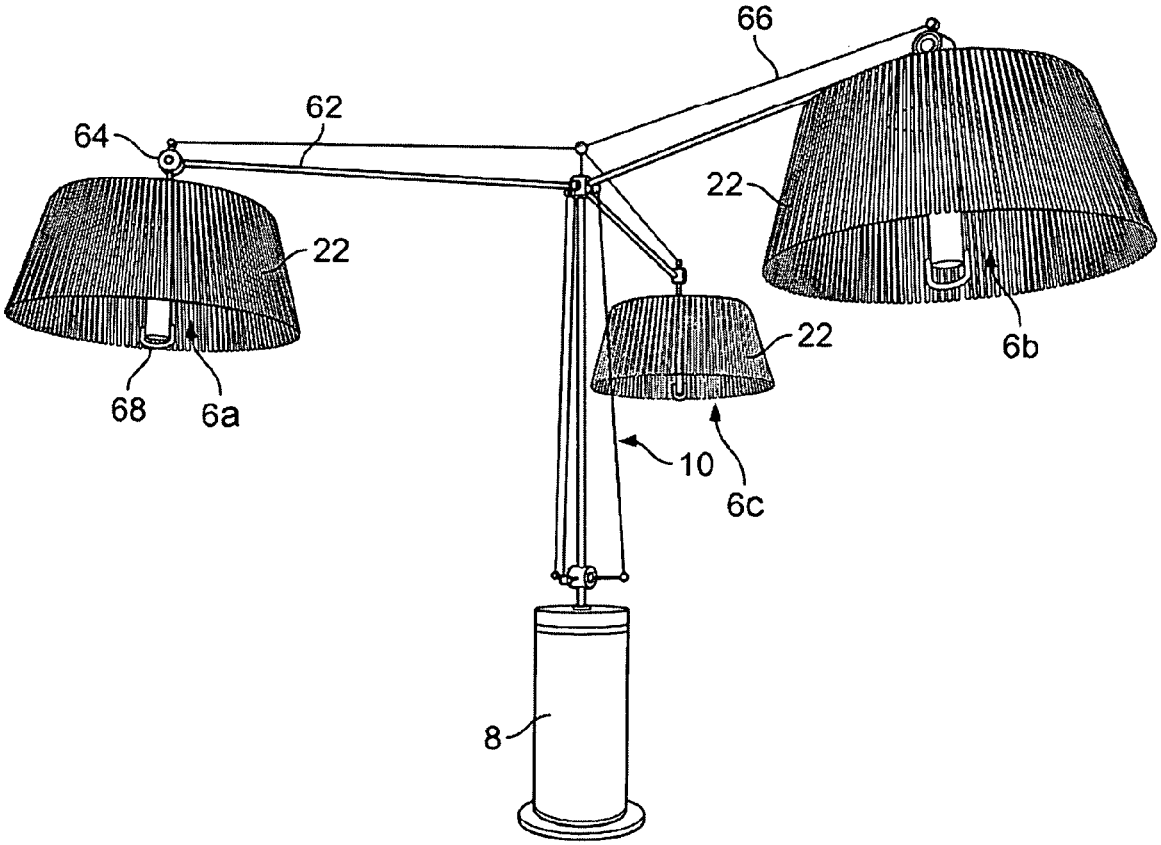

FIGS. 8*a* and 8*b* illustrate that the heater can have three heater heads 6*a*, 6*b* and 6*c*. The heater heads 6*a*, 6*b* and 6*c* can each have an individual heat emitter 14.

Figure 9A:
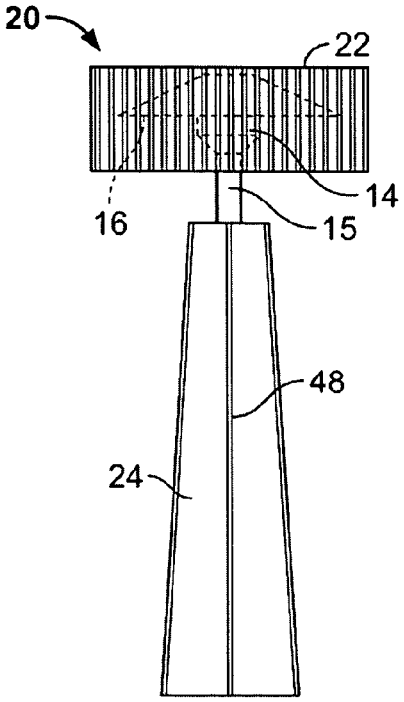
FIGS. 9*a* through 9*d* illustrate variations of signage on the heater with a variation of the heater cover.

FIG. 9*a* illustrates that the body cover 24 can have a cut-off (as shown) or complete pyramid configuration. The head cover 24 can be translucent. The head cover 22 can be corrugated. The head cover 22 can have a square cross section transverse to the longitudinal axis. The head cover 22 can have a uniform transverse cross section with respect to the longitudinal axis 12.

Figure 9B:
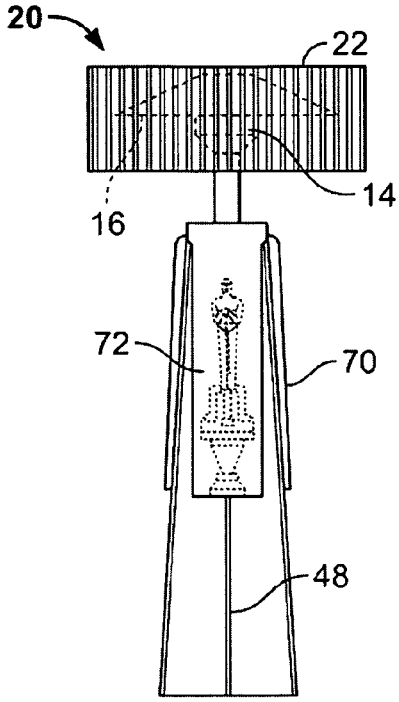
Figure 9C:
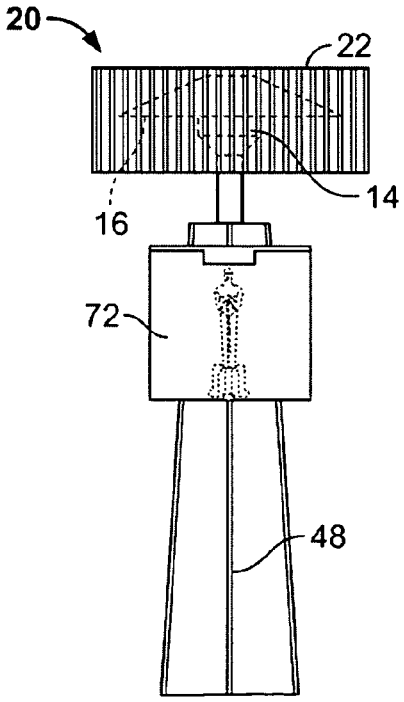
Figure 9D:
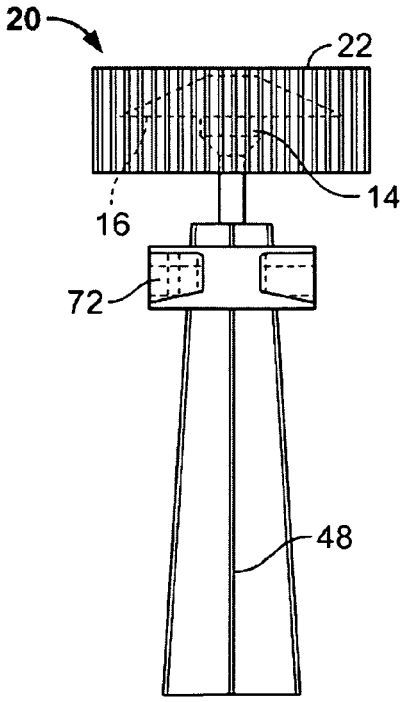

FIGS. 9*b*, 9*c* and 9*d* illustrate that the heater 2 can have one or more signs 72 fixedly or removably attached to or integral with the body cover 24 and/or head cover 22. The signs 72 can be fastened to the heater 2 or heater cover 20 using glue, adhesive, any of the other fasteners 70 disclosed herein, or combinations thereof.

The signs 72 can have a surface with one or more visible graphics comprising text and/or images. The graphics can be black and white or color printed, engraved, embossed, or combinations thereof. The sign 72 can have a static (e.g., fixed print and/or embossing) and/or a dynamic display (e.g., changing or variable print and/or embossing). For example, the dynamic display can have a light emitting monitor (e.g., CRT display, plasma display, LCD display, LED display), a rotating or scrolling fabric or paper strip, attached to one roller on each side of the strip, a series of timed rotating elements (e.g., ActionMaster by Mobile Master Manufacturing, LLC, Nashville, Tenn.), or combinations thereof.

The sign 72 can be larger than a branding label for the heater 2, for example, the sign 72 can be taller than 5 cm (2 in.) and wider than 5 cm (2 in.), or taller than 10 cm (4 in.) and wider than 10 cm (4 in.), or taller than 15 cm (6 in.) and wider than 15 cm (6 in.), or taller than 30 cm (12 in.) and wider than 30 cm (12 in.), or taller than 61 cm (24 in.) and wider than 61 cm (24 in.).

FIG. 9*b* illustrates that the body cover 24 can have a sign 72 attached to each of one to four sides of the body cover 24. The body cover 24 and/or sign 72 can have a fastener 70 that can removably attach the body cover 24 to the sign 72, or vice versa, or the body cover 24 and the sign 72 to the fastener 70.

FIG. 9*b* illustrates that the sign 72 can be narrower than the body cover 24 at the height at which the sign 72 is attached to the body cover 24. The sign 72 can be in a frame. FIG. 7*c* illustrates that the sign 72 can be wider than the body cover 24 at the height at which the sign 72 is attached to the body cover 24. FIG. 7*d* illustrates that the sign 72 can be retractably or extendably rolled or folded when not in use.

Figure 10C:
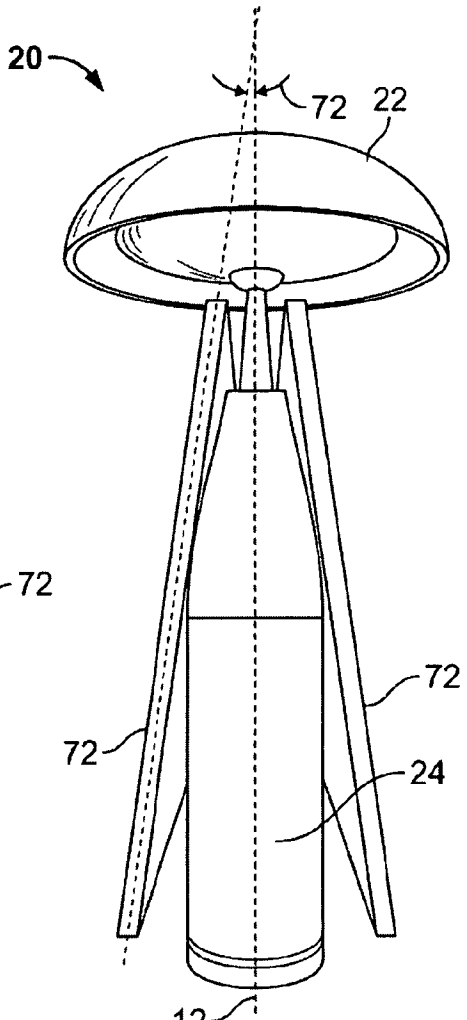
FIGS. 10*a*, 10*b* and 10*c* illustrate front, front three-quarters, and side views, respectively, of the heater with a variation of the heater cover having variations of signage.
Figure 10B:
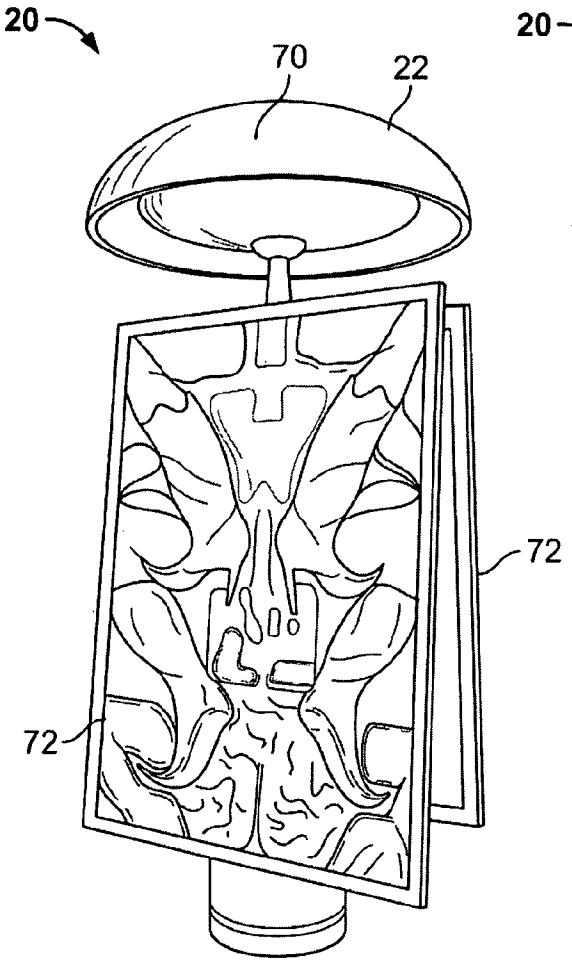
Figure 10A:
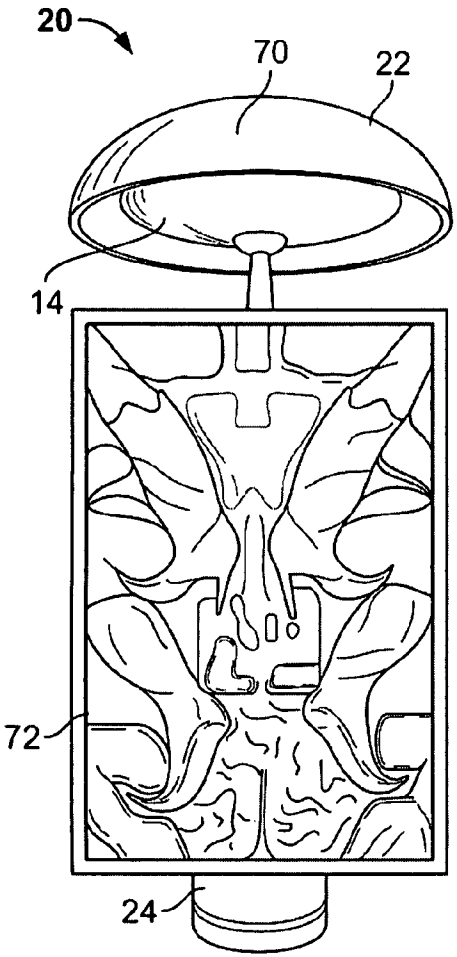

FIGS. 10*a*, 10*b* and 10*c* illustrate that a sign 72 can be attached to or printed on the head cover 22. The body cover 24 can be attached to one, two or more signs 72. The signs 72 can be wider than that body cover 24 and/or wider than the head cover 22.

The top of the body cover 24 can have a sloped angle (as shown in FIG. 8*c*) that can hold the signs 72 at a sign slope angle 74 with respect to the longitudinal axis 12. The sign slope angle 74 can be from about −60° to about 90° (e.g., the sign 72 can form a counter 46). For example, the sign slope angle 74 can be from about −60° to about 0°, more narrowly from about −45° to about −15°, for example about −30°. The sign slope angle 74 can be from about 0° to about 90°, more narrowly from about 5° to about 60°, for example about 15°.

Figure 11:
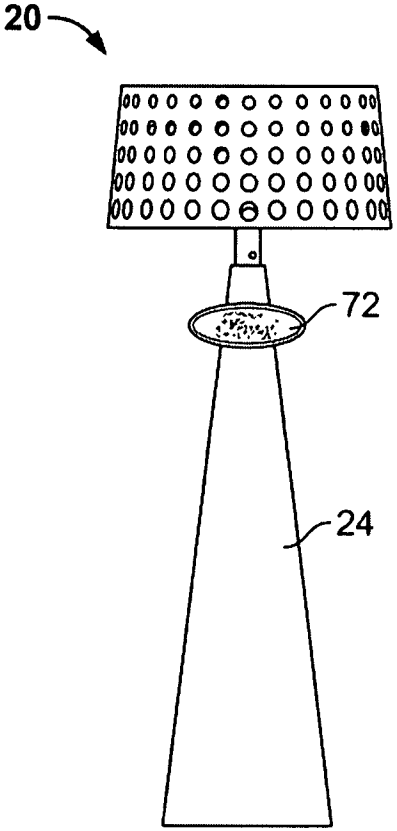

FIG. 11 illustrates that the sign 72 can be mounted on a frame attached to body cover 24. The frame can extend away from the body cover 24, for example holding the sign 72 away from the body cover 24.

Figure 12:
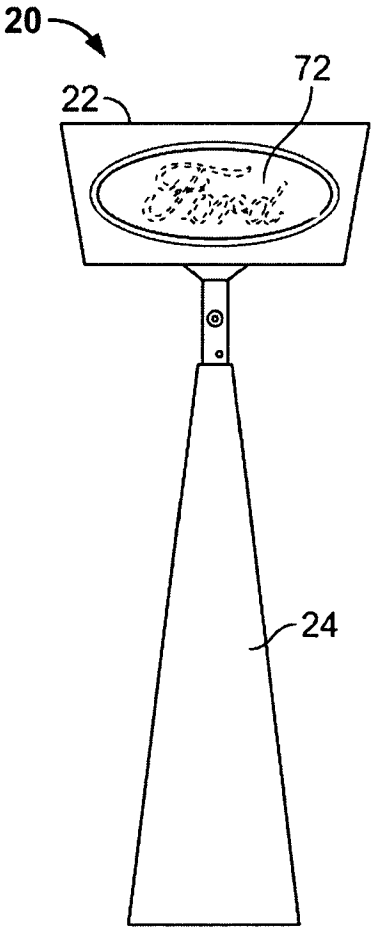

FIG. 12 illustrates that the sign 72 can be attached to the head cover 22. The sign 72 can be removably attachable from the head cover 22. For example, the sign 72 can be made from a flexible magnet. The sign 72 can be attached to the head cover 22 by a fastener described herein. The sign 72 can be integral with the head cover 22. For example, the sign 72 can be etched into or painted or coated onto the head cover 22.

Figure 13:
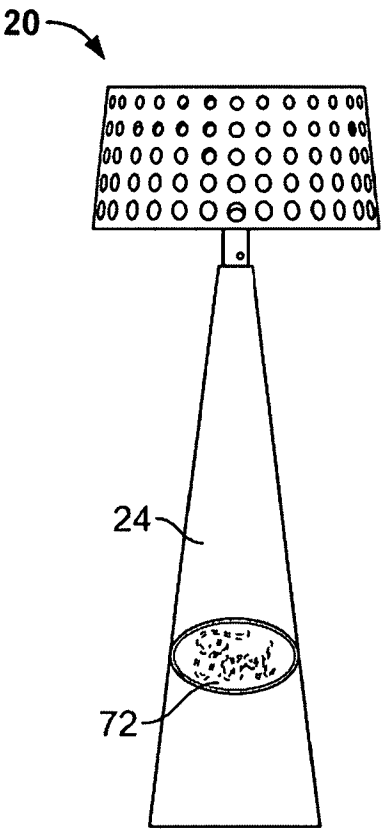
FIGS. 11 through 14 and 15*a* illustrate variations of the heater cover having variations of signage.

FIG. 13 illustrates that the sign 72 can be attached to the body cover 24. The sign 72 can be removably attachable from the body cover 24. For example, the sign 72 can be made from a flexible magnet. The sign 72 can be attached to the body cover 24 by a fastener described herein. The sign 72 can be integral with the body cover 24. For example, the sign 72 can be etched into or painted or coated onto the body cover 24. The cover 24 or head cover 22 may also be completely covered or wrapped in vinyl material conforming to the cover 24 shape for the purpose of advertising or decoration (such as wrapping of vehicles for use as mobile billboards).

The heater 2 can have speakers and/or lighting in, behind, adjacent to the signs 72, and/or anywhere on the heater 2, for example in or on the body cover and/or head cover and/or tower cover. Any or all of the covers can be translucent, transparent, opaque, or combinations thereof. The speakers and/or wires can be connected to data sources wired and/or wirelessly. Music and/or spoken word (e.g., commercial information) can be broadcast through the speakers. The data and/or power for the speakers and/or lighting can be internal to the heater 2, and/or external to the heater 2.

Figure 14:
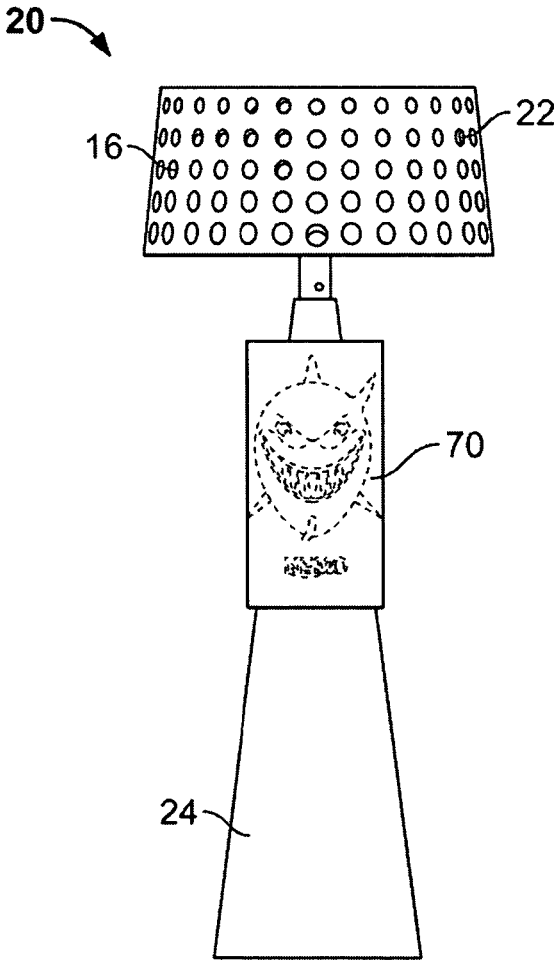

FIG. 14 illustrates that any variation of the heater cover 20 can have one or more signs 72. For example, the heater cover 20 can have a head cover 22 that can have holes. The head cover 22 can be similar to the head cover 22 of the variation of FIG. 4*j*.

Figure 15C:
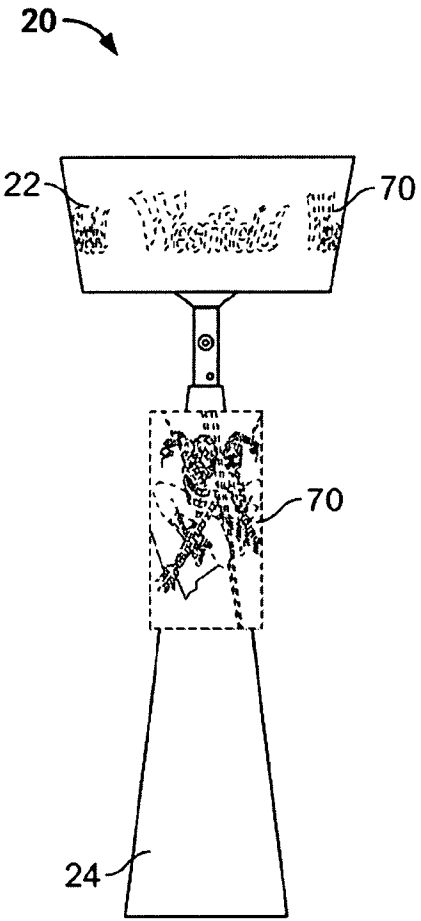
FIGS. 15*b* and 15*c* illustrate variations of the heater cover of FIG. 15*a* with one or more signs.
Figure 15B:
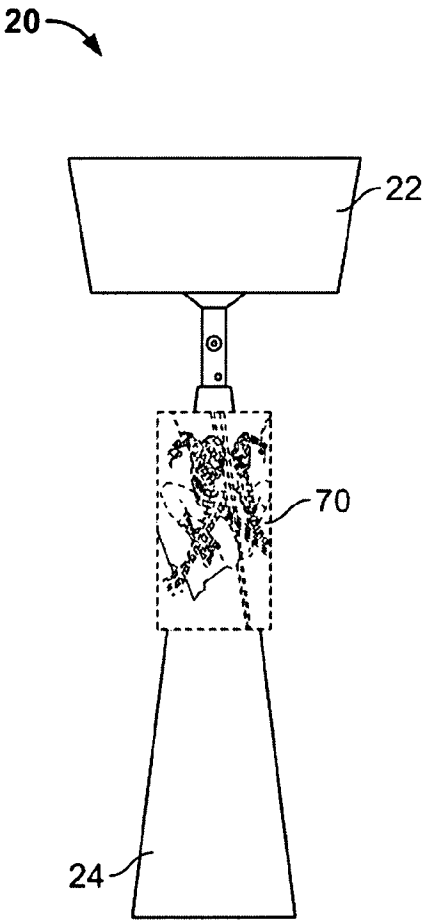
Figure 15A:
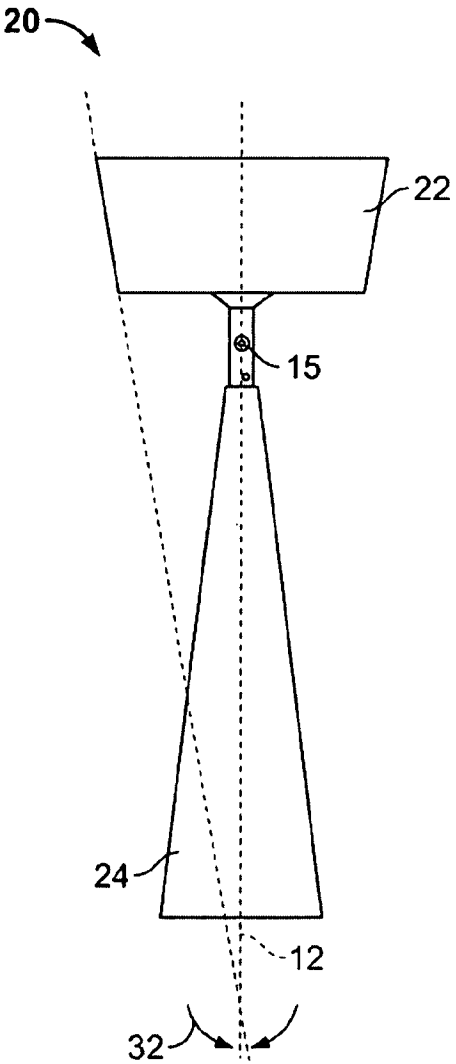

FIG. 15*a* illustrates that the heater cover 20 can have a head cover 22 with a head cover slope 32 less than 0°. The head cover slope 32 can be tilted downward (i.e., having a head cover slope 32 less than 0°), as shown.

FIG. 15*b* illustrates that the heater cover 20 can have a sign 72 on the body cover 24 (e.g., on the tower cover 36 or the base cover 34) and have a head cover 22 with a head cover slope 32 less than 0°.

FIG. 15*c* illustrates that the heater 2 can have a sign 72 on the body cover 24 (e.g., on the tower cover 36 or the base cover 34) and/or have a sign 72 on the head cover 22. The head cover 22 can have a head cover slope 32 less than 0°. The sign 72 on the head cover 22 can be tilted downward, upward, or perpendicular to the ground. The sign 72 on the body cover 24 can be tilted downward, upward, or perpendicular to the ground.

Figure 17:
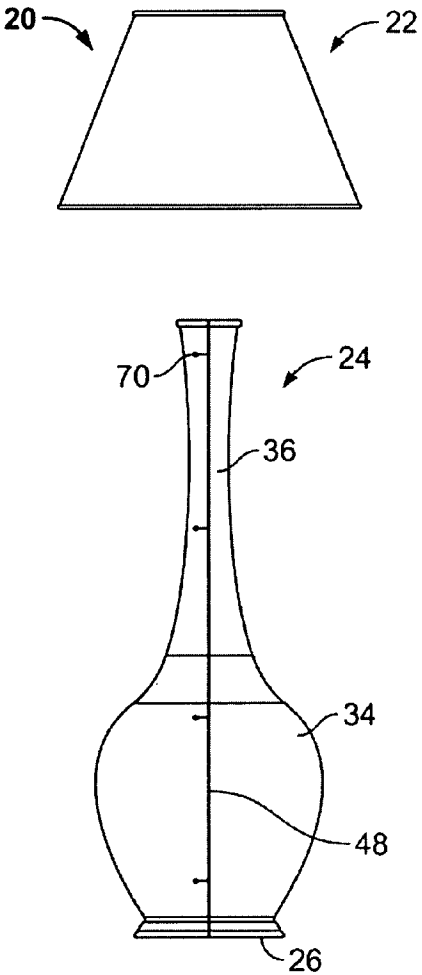
FIG. 17 illustrates a variation of the heater cover.
Figure 16:
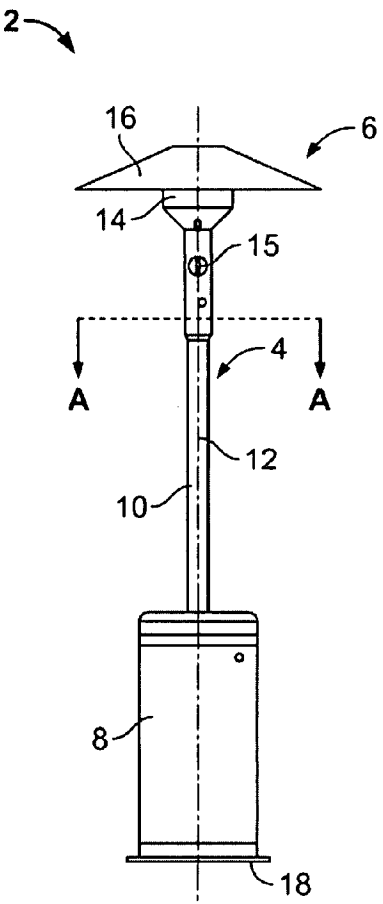
FIG. 16 illustrates a variation of an uncovered tower heater, not the invention.

FIG. 16 illustrates the heater 2 similar to the heater 2 of FIG. 1. FIG. 17 illustrates that the body cover 24 can have a seam 48. The body cover 24 can have one or more fasteners 70. The fasteners 70 can hold the seam 48 together.

Figure 18:
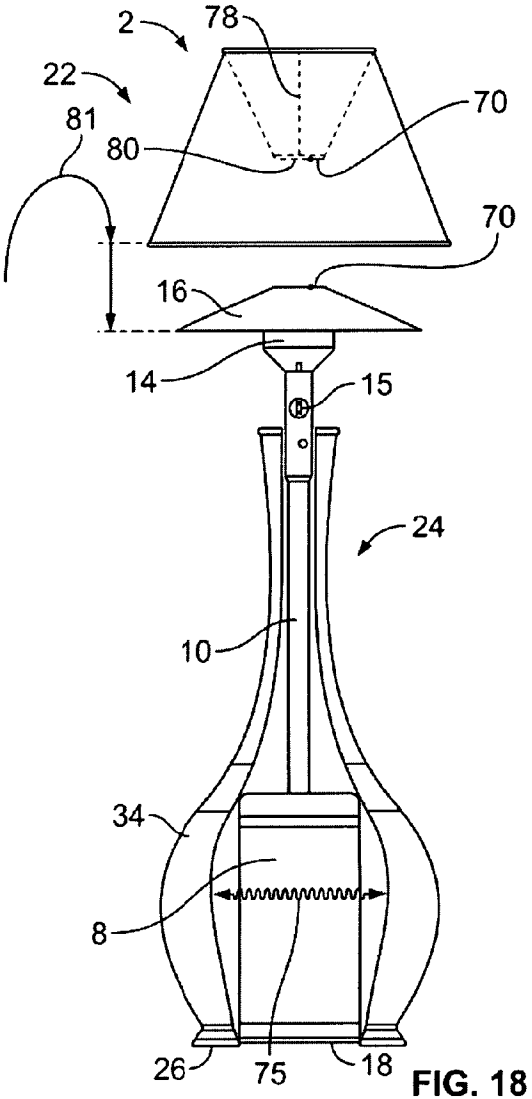
FIG. 18 illustrates the heater cover of FIG. 17 attached to the heater of FIG. 16 with the body cover shown as a sectional view for illustrative purposes.

FIG. 18 illustrates that the body cover 24 can be elastic or otherwise resilient. The fasteners 70 can be unfastened. As shown in FIGS. 18 and 20, the body cover 24 can be stretched open at the seam 48, as shown by arrows 75, and translated 76, as shown by arrow in FIG. 19, and wrapped around the body 4. The base cover 34 can be wrapped around the base 8. The tower cover 36 can be wrapped around the tower 10.

Figure 19:
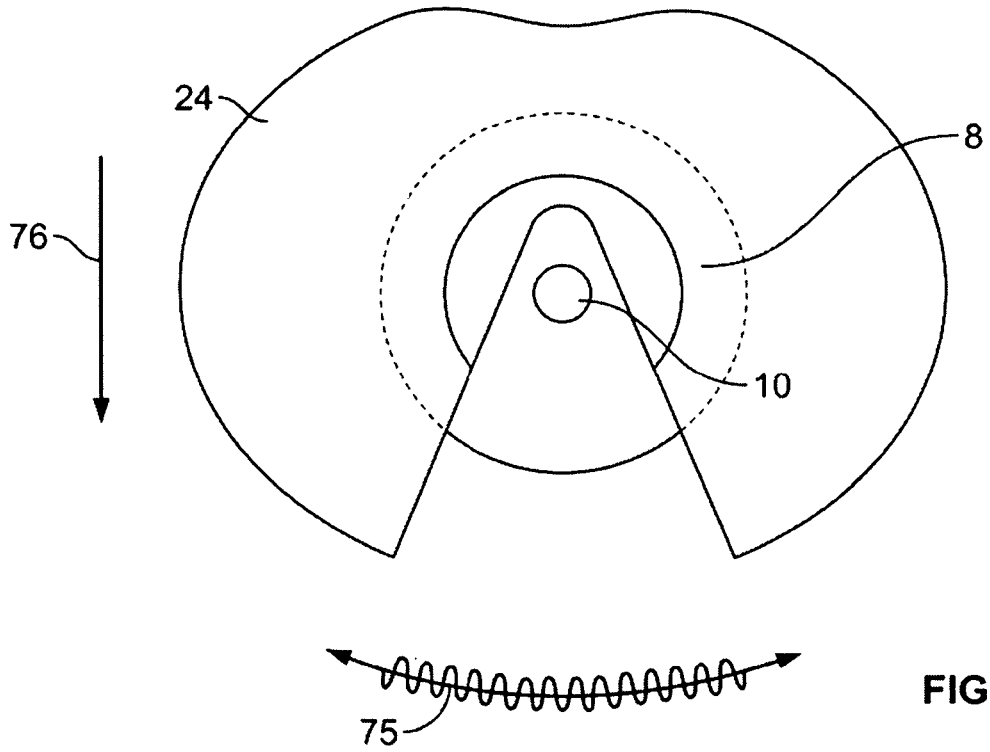
FIG. 19 is a top view of a variation of attaching the body cover to the base and tower.
Figure 20:
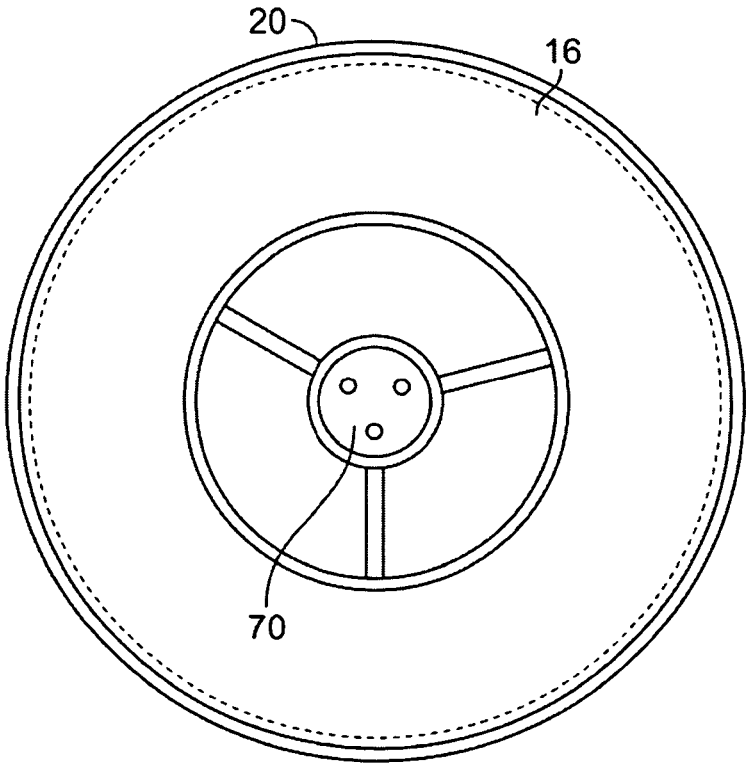
FIG. 20 is a top view of a variation of the head cover on the heater head.

As shown in FIGS. 19 and 20, the heater head 6 can have a rigid, internal head frame 78 and a head connector 80. The head connector 80 can be configured to attach to the heat shield 16 and/or top of the tower 10 or heat emitter 14. The head connector 80 can have one or more fasteners 70. The heat shield 16 and/or top of the tower 10 or heat emitter 14 can have one or more fasteners 70. The head cover 22 can be lowered onto the heat shield 16 or top of the tower 10, as shown by arrows 81.

Corresponding fasteners 70 on the heater cover 20 and, where applicable, the uncovered heater 2 can be fastened after the heater cover 20 is positioned on and/or around the uncovered heater 2.

Figure 22:
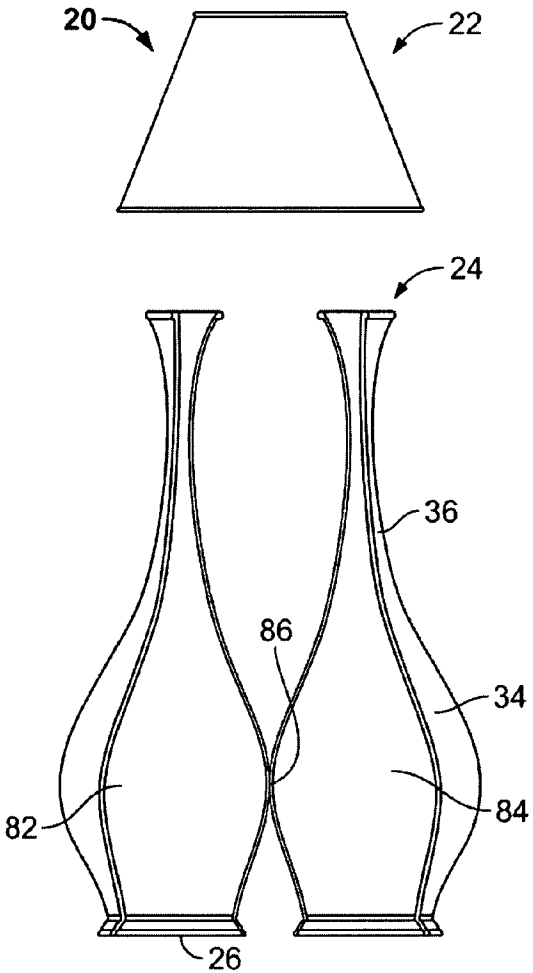
FIG. 22 illustrates a variation of the heater cover in an opened configuration.
Figure 21:
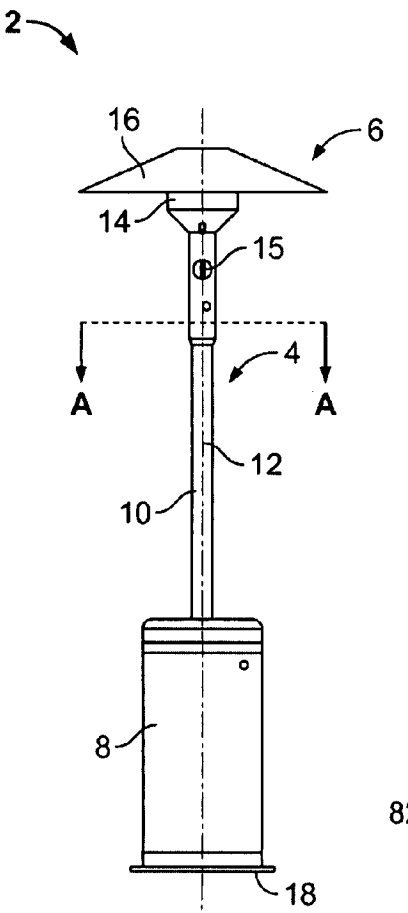
FIG. 21 illustrates a variation of an uncovered tower heater, not the invention.

FIG. 21 illustrates the heater 2 similar to the heater 2 of FIGS. 1 and 16. FIG. 22 illustrates that the heat cover heater cover 20 (heater not shown) and/or body cover 24 can have a cover first section 82 and a cover second section 84. The cover first section 82 can be rotatably attached to the cover second section 84, for example at a body cover hinge 86. The cover sections can be rigid.

Figure 24:
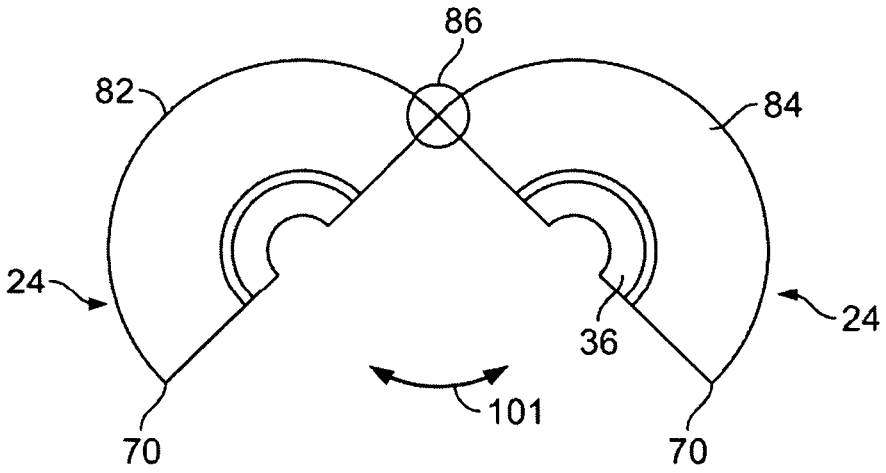
FIG. 24 is a top view of a variation of opening the body cover.

FIG. 24 illustrates that the cover can be opened by first unfastening the fasteners 70, if applicable. Then the cover first section 82 can be rotated, as shown by arrows 101, about the hinge 64 away from the cover second section 84.

Figure 23:
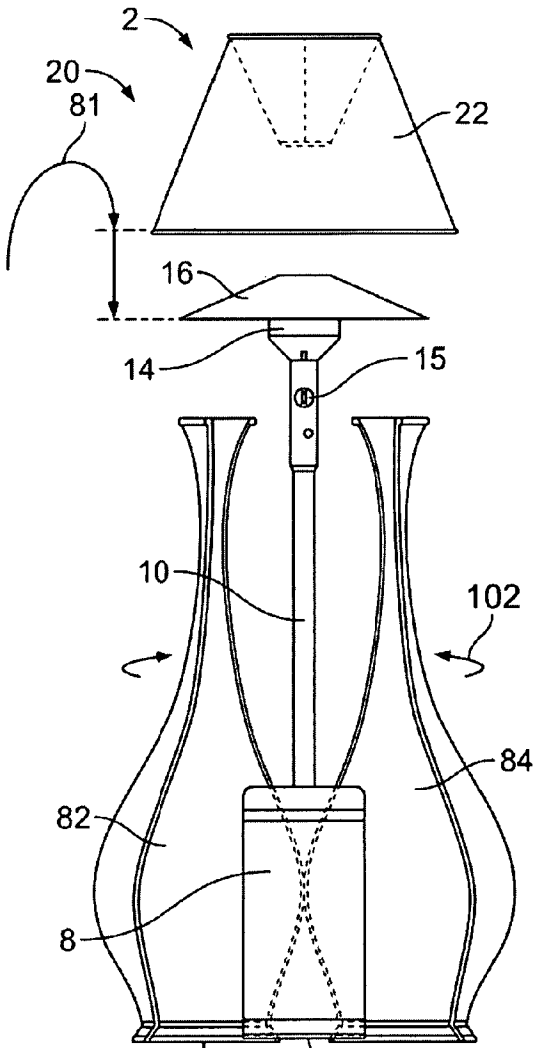
FIG. 23 illustrates a variation of a method for attaching the heater cover of FIG. 22 attached to the heater of FIG. 21.
Figure 25:
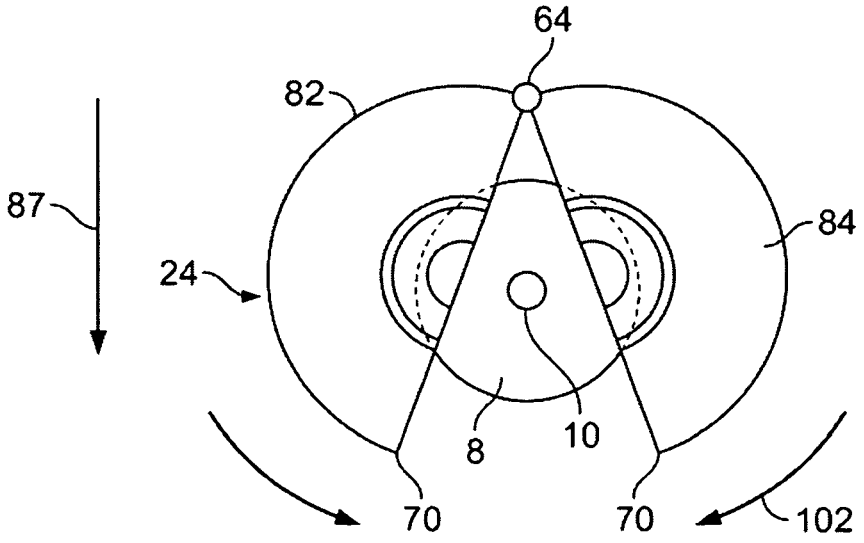
FIG. 25 is a top view of a variation of attaching the body cover to the body.

FIGS. 23 and 25 illustrate that the opened body cover 24 can be translated, as shown by arrow 87, around the base 8 and tower 10. Once the body cover 24 is in place around the body 4, the cover first section 82 can be rotated, as shown by arrows 102, with respect to the hinge 64 toward the cover second section 84. The fasteners 70 can then be attached to each other.

The cover first section 82 can be completely separate (e.g., not attached at a hinge 64) from the cover second section 84 before use. The cover first section 82 and cover second section 84 can be translated in a position to together surround the body 4. Fasteners 70 on the cover first section 82 can then be attached to fasteners 70 on the cover second section 84.

Figure 26:
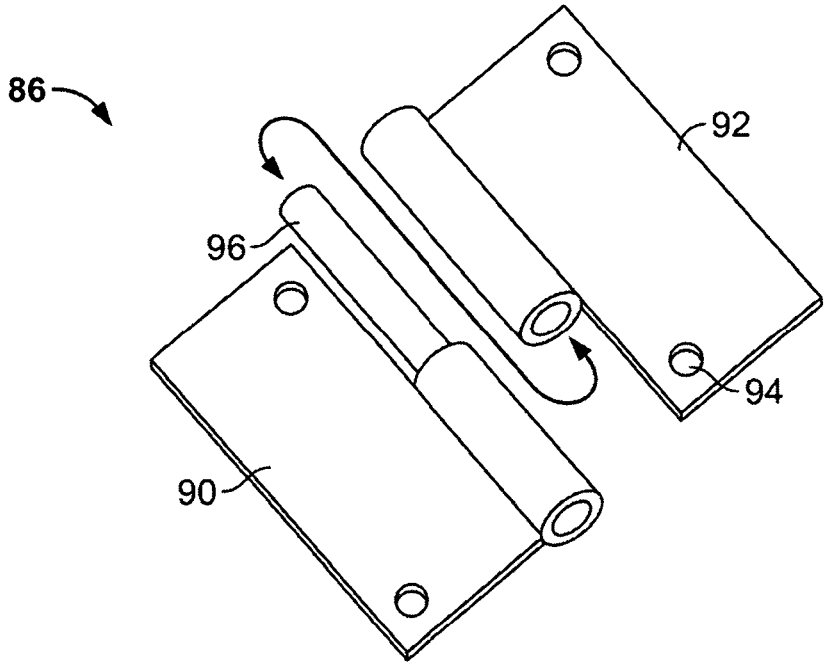
FIGS. 26 and 27 illustrate variations of the cover hinge.

FIG. 26 illustrates that the cover hinge 86 or the fastener 70 can have a first hinge panel 90 and a second hinge panel 92. The hinge panels can be secured to the respective cover sections through hinge panel holes 94 (e.g., with screws, nails, rivets, glue). The first hinge panel 90 can be rotatably attached to the second hinge panel 92 by a hinge pin 96. The hinge pin 96 can telescope. The second hinge pin 96 can slidably translate 76, as shown by arrows, along the hinge pin 96.

Figure 27:
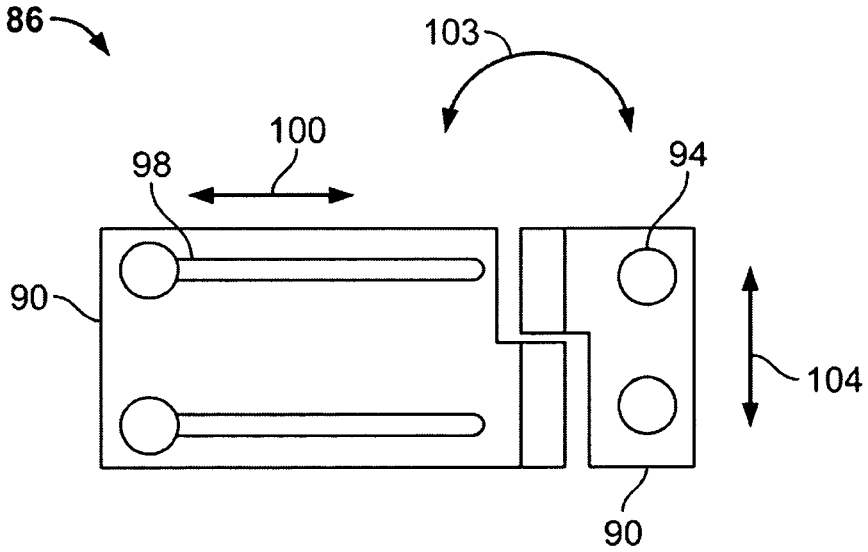

FIG. 27 illustrates that the first 90 and/or second hinge panels 92 can have hinge panel slots 98 in a perpendicular direction to the hinge pin 96. The hinge panel slots 98 can allow the first 90 and/or second hinge panel 92 to have a first translation, as shown by arrows 100. The first hinge panel 90 can rotate, as shown by arrows 103, with respect to the second hinge panel 92. The second hinge panel 92 can move in a second translational direction, as shown by arrows 104, along the hinge pin 96.

Figure 28:
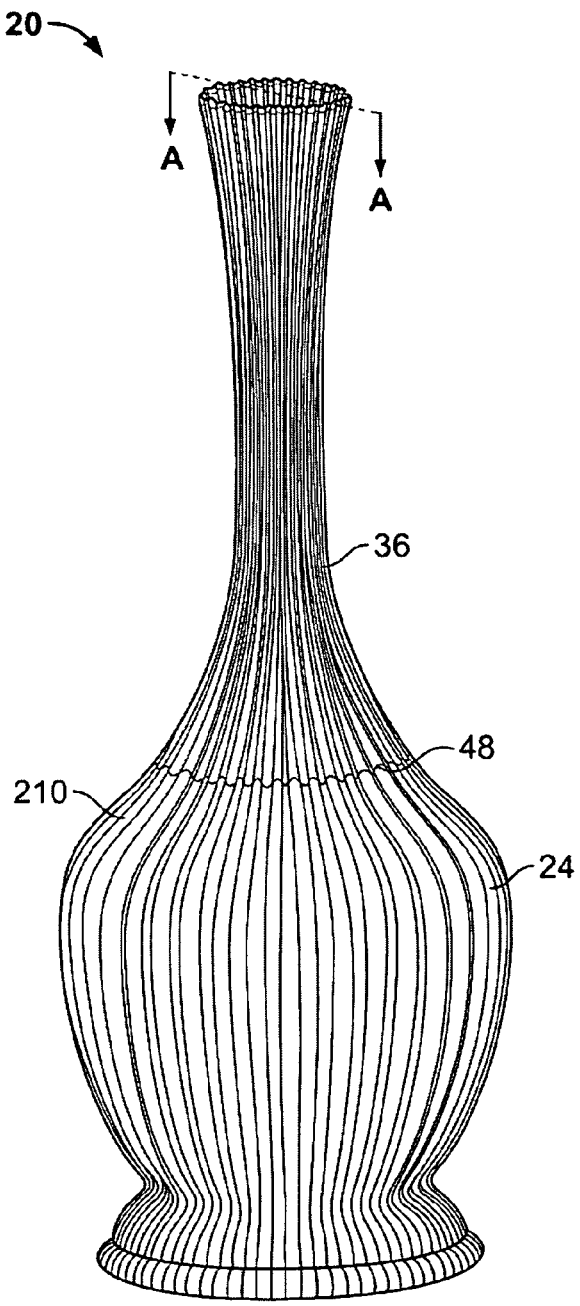
FIG. 28 illustrates a variation of the heater cover.
Figure 29:
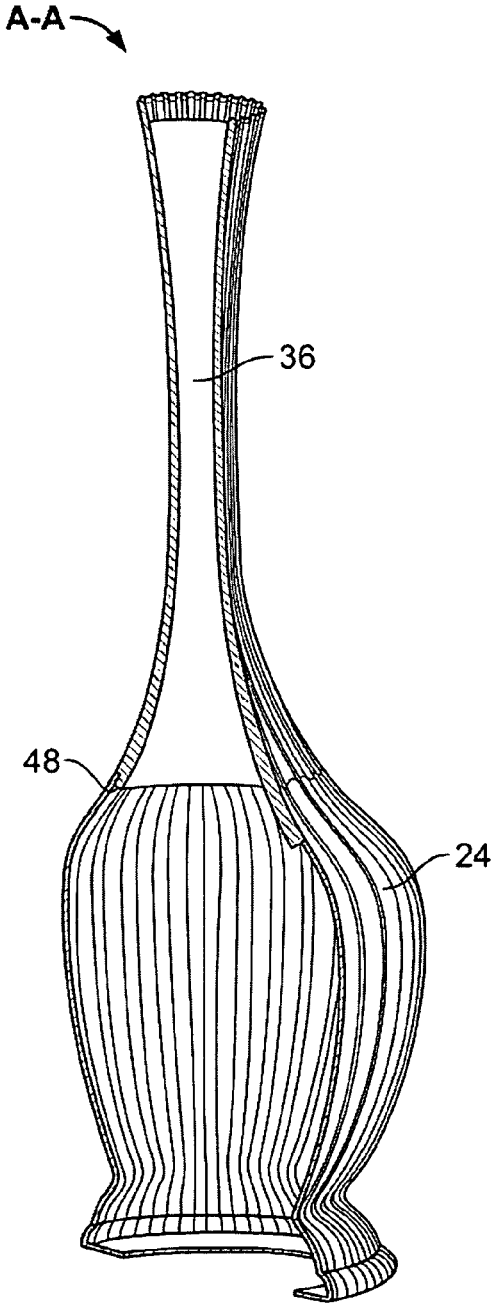
FIG. 29 illustrates a variation of cross-section A-A of FIG. 28.

FIGS. 28 and 29 illustrate that the heater cover 20 can have a tower cover 36 that can be fixedly or removably attached to the body cover 24 at a seam 48. The tower cover 36 can snap to the body cover 24. The tower cover 36 can be attached to the body cover 24 by fasteners, for example as described herein.

Any or all parts of the heater cover 20 can have horizontal and/or vertical ridges 210, ribs or grooves. The ridges 210 on the body cover 24 can align to the ridges 210 on the tower cover 36.

Figure 31:
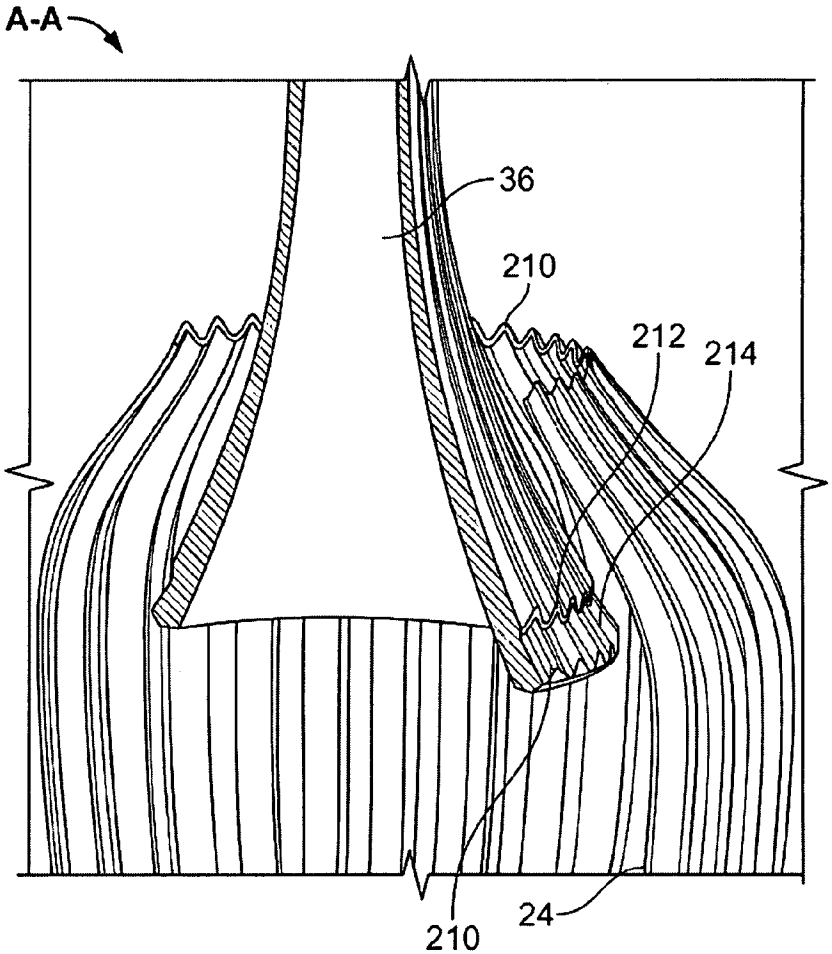
FIG. 31 illustrates a close-up of a portion of the cover in the cross-section A-A of FIG. 30.
Figure 30:
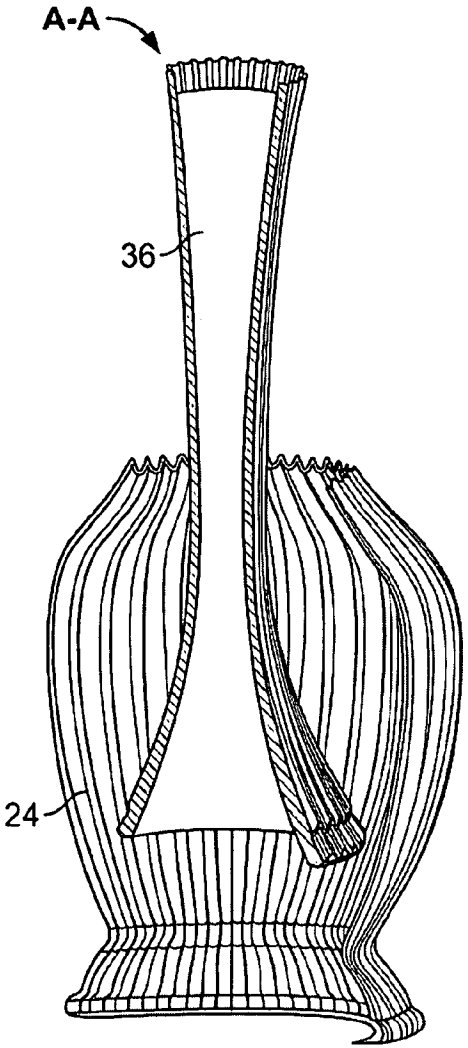
FIG. 30 illustrates the heater cover in the cross-section A-A of FIG. 29 in a disassembled configuration.
Figure 32B:
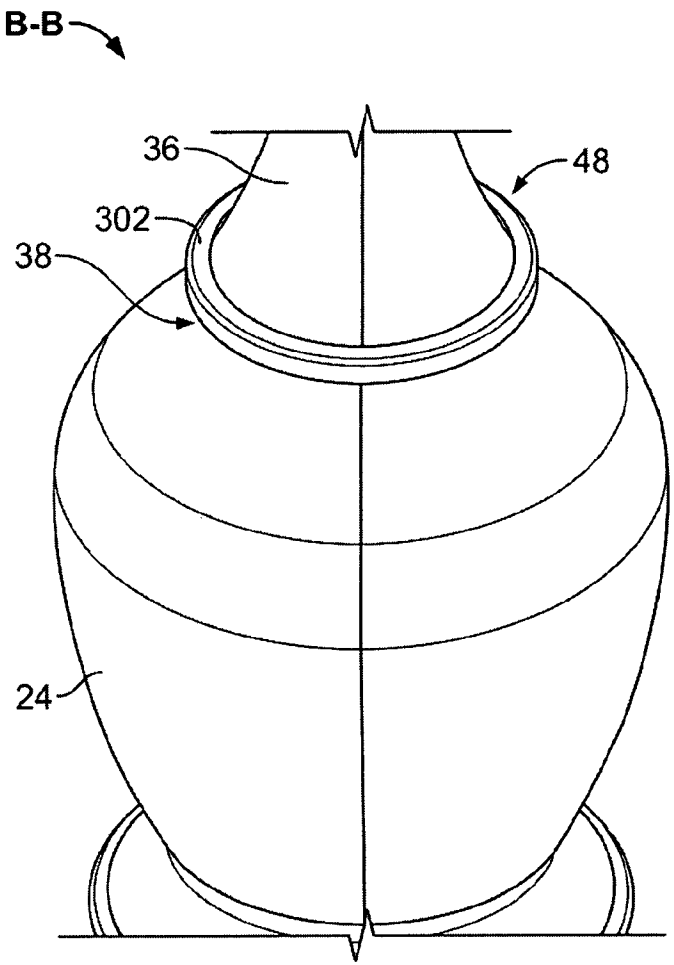
FIG. 32*b* is a variation of close-up view B-B of FIG. 32*a*.
Figure 32A:
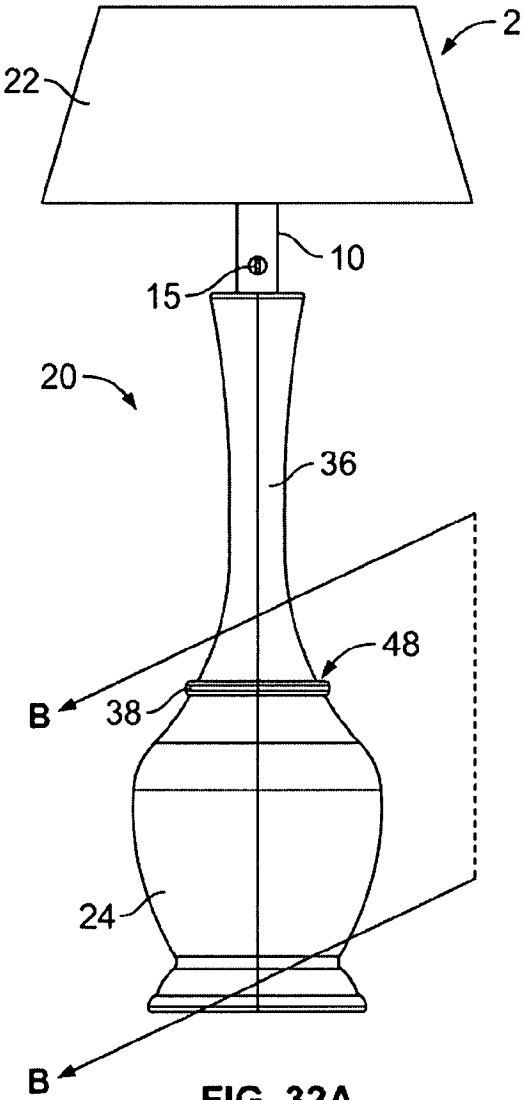
FIG. 32*a* is a side view of a variation of the heater cover in a closed configuration on the heater.
Figure 32D:
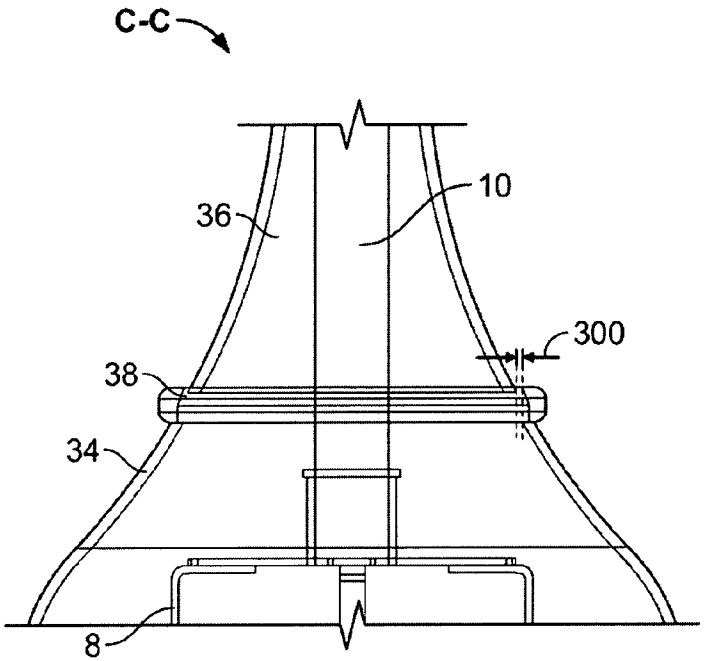
FIG. 32*d* is a variation of close-up view C-C of FIG. 32*c*.
Figure 32C:
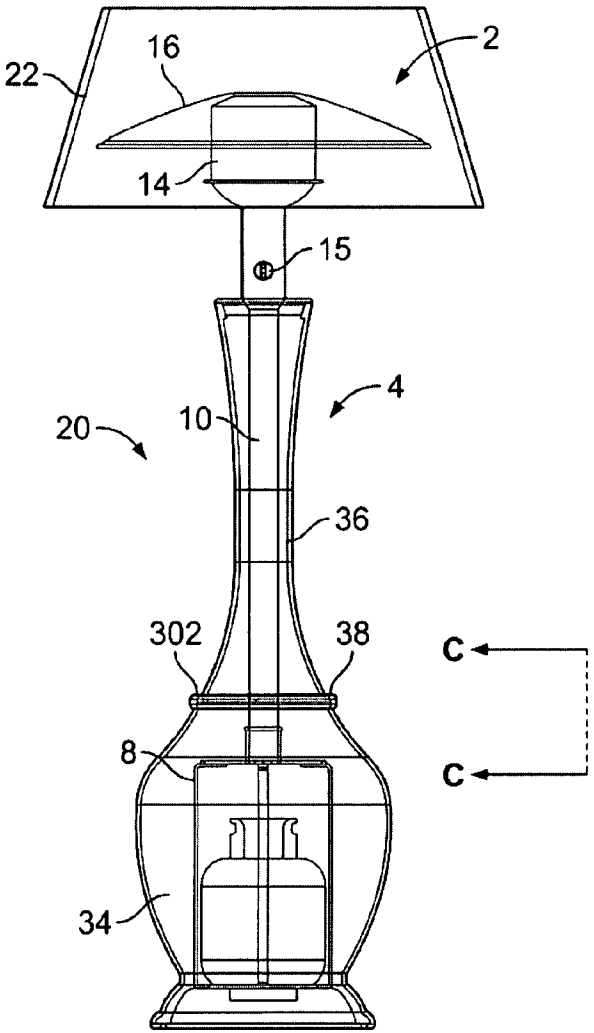
FIG. 32*c* is a see-through schematic view of a variation of the heater cover and heater of FIG. 32*a*.

FIGS. 30 and 31 illustrate that the body cover 24 and the tower cover 36 can be detached from each other. The tower cover 36 can telescope into the body cover 24. The tower cover 36 can have an interfacing surface 214 and, for example, an abutment 212. The interfacing surface 214 can be thinned compared to the wall on the other side of the abutment 212 from the interfacing surface 214. The abutment 212 can lay flat or flush against the body cover when the tower cover 36 is attached to the body cover 24.

During assembling and attaching of the tower cover 36 to the body cover 24, the tower cover 36 can be snap-fitted, glued (or other adhesive, epoxy), attached via one or more pieces of hook and loop tape (e.g., Velcro); one or more pieces of interlocking stem and head tape (e.g., Dual Lock from 3M Corporation of Minneapolis, Minn.), attached via a pressure collar, or used with any fastener listed herein or combinations thereof to or from the body cover 24. Once assembled, the seam 48 can be substantially horizontal.

For example, a propane or other liquid or gas fuel tank and/or electrical power supply and controls can be stored inside the body cover 24. For example, to access (e.g., for service or replacement) the propane tank and/or power supply and controls, the body cover 24 can be detached from the tower cover 36 and the body cover 24 can then be lifted above the propane tank and/or power supply and controls for rapid access. The tower cover 36 can be permanently or semi-permanently attached to the heater column 10 or removed during the accessing, for example, of the propane tank under the cover 24.

FIGS. 32*a* through 32*d* illustrate a variation similar to that shown in FIG. 4*a*. The base cover 34 can be attached to the tower cover 36 by a joint 38. The joint 38 can have one or more joiners, such as seals, rings, straps, clamps, or combinations thereof. The joiners can removably or fixedly attach the base cover 34 to the tower cover 36. The joiners 302 can clip, snap, clamp, or combinations thereof to the base cover 34 and/or the tower cover 36.

The tower cover 36 can be fixed or separably attached to the tower 10. For example, the tower cover 36 can be attached to the tower 10 via brackets, clamps, hooks, or combinations thereof internal to the tower cover 36. The base cover 34 can be separate and unattached from the tower cover 36 and the tower 10. The base cover 34 can be attached or unattached from the base and/or tower. A joiner, such as a ring, can have serve merely to hide or obscure the seam 48 between the base cover 34 and the tower cover 36 and not to join the tower cover 36 to the base cover 34.

For example, the tower cover 36 and the base cover 34 can be made as a single unit, then cut above, below, or through the ring at the joint 38 to separate the tower cover 36 and the base cover 34.

The inner diameter of the base cover 34 at the joint 38 can be larger than the outer diameter of the tower cover 36 at the joint 38. The minimum inner diameter of the base cover 34 can be larger than the maximum outer diameter of the tower cover 36.

The tower cover 36 can attach or be separate from the base cover 34. If the tower cover 36 is separate from the base cover 34, a cover gap 300 can be between the top of the most adjacent part of the top of the base cover 34 to the most adjacent bottom part of the tower cover 36. The cover gap 300 can be about equal to or less than 1.25 in.

Figure 33B:
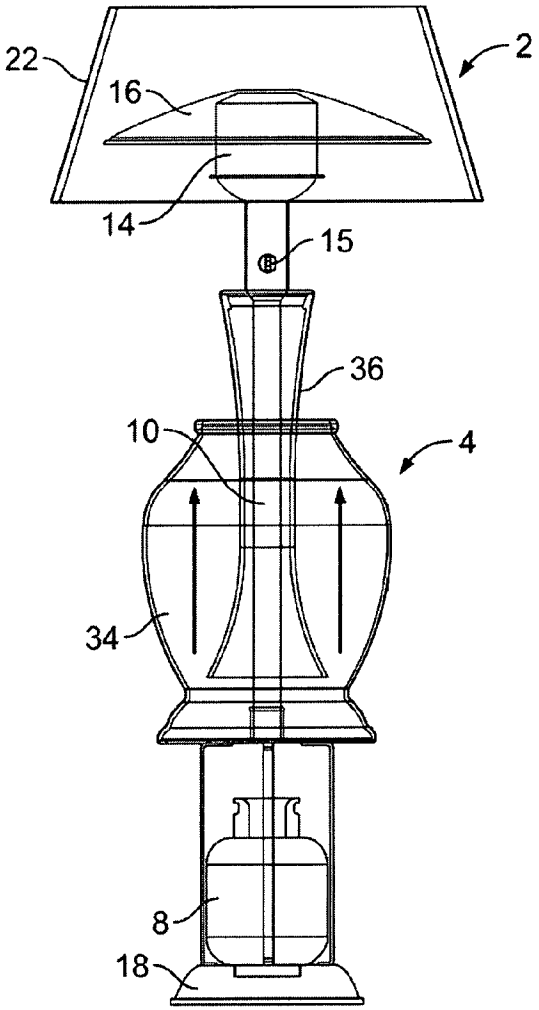
FIG. 33*b* is a see-through schematic view of a variation of the heater cover and heater of FIG. 33*a*.
Figure 33A:
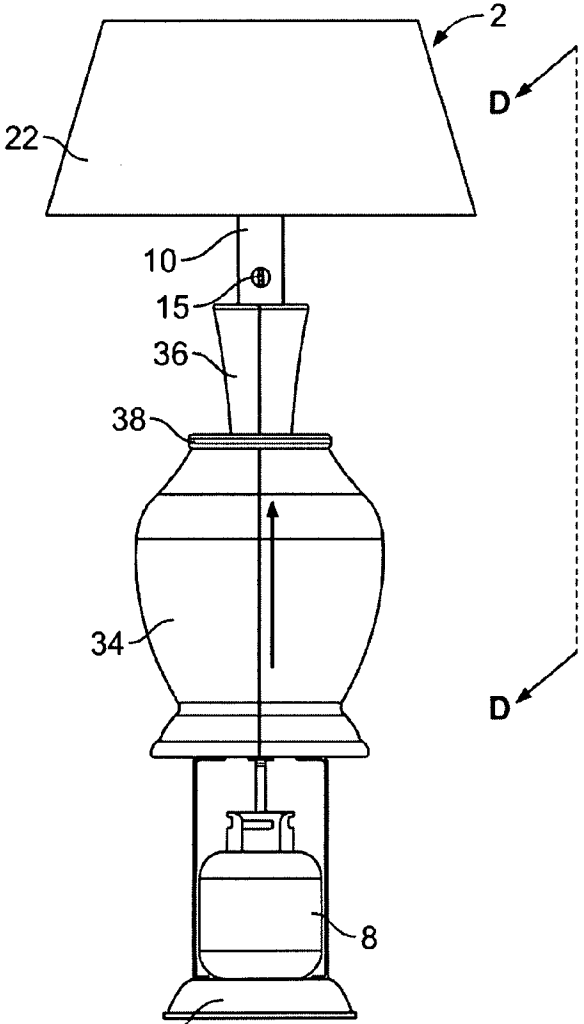
FIG. 33*a* is a side view of a variation of the heater cover in an open configuration on the heater.
Figure 33C:
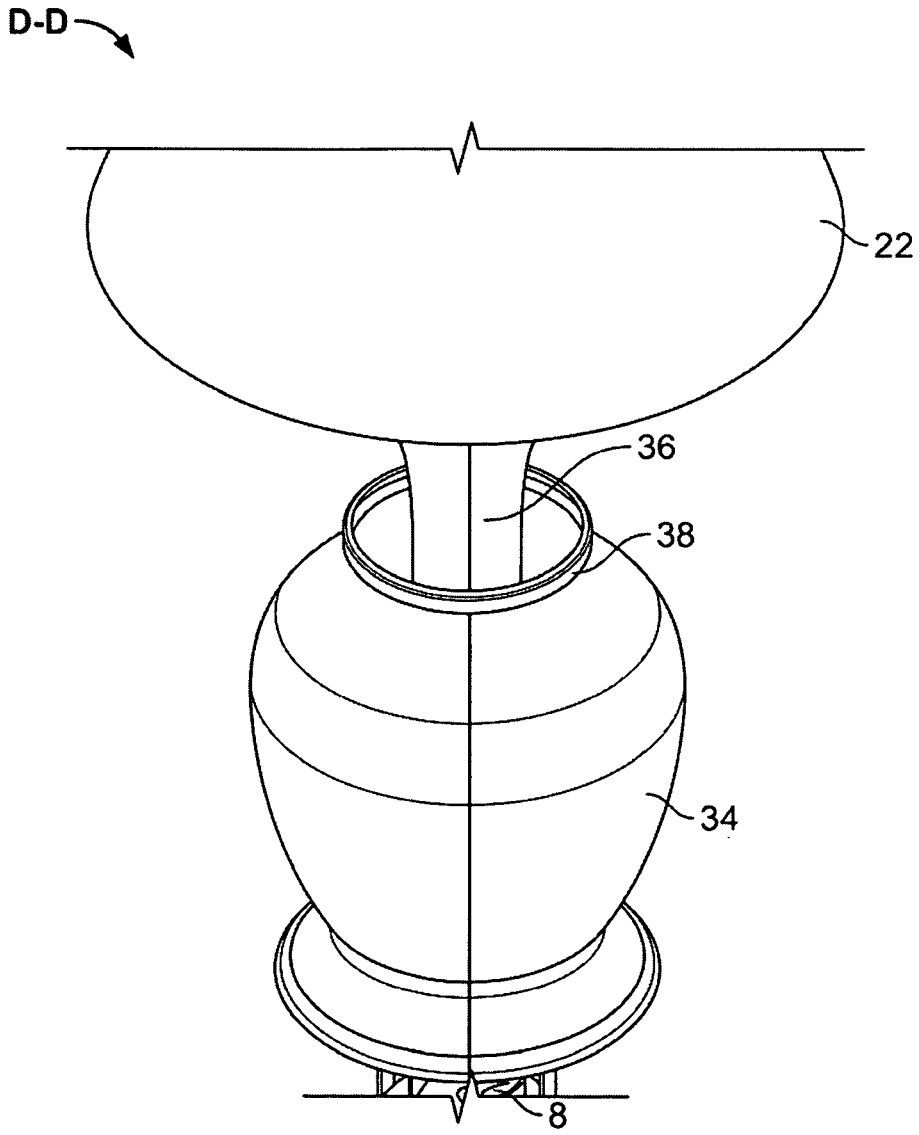
FIG. 33*c* is a variation of close-up view D-D of FIG. 33*a*.

FIGS. 33*a* through 33*c* illustrate that the one or more joiners 302 can be detached from the tower cover 36 (as shown) and/or the base cover 34, for example, separating the base cover 34 from the tower cover 36. The base cover 34 can instead be separate and unattached from the tower cover 36.

The base cover 34 can be raised, as shown by arrows, for example to expose the contents of the base 8. For example, the base cover 34 can be slid or otherwise lifted at least partially vertically concurrent with the tower cover 36. The base cover 34 can be radially inside or outside of the tower cover 36. The base cover 34 can be lifted above the tower cover 36. The base 8 can include a propane or other fuel tank or controls. The base cover 34 can be moved temporarily to a position around a part or all of the length of the tower cover 36.

The contents of the base 8 can be accessed, for example, the fuel tank can be serviced or replaced. The base cover 34 can then be lowered to the position shown in FIGS. 32*a* through 32*d*. The base cover 34 can be reattached to the tower cover 36, if desired and possible based on the design.

The tower cover 36 can be configured to be slidably or otherwise lowered at least partially vertically concurrent with the base cover 34. The tower cover 36 can be lowered to the ground.

The base cover 34 can be configured to be not directly attached to the base. For example, the base cover 34 can be resting freely on or anchored to the ground and/or pressed down by or attached to the tower cover 36 when the base cover 34 is in a position encircling the base. The tower cover 36 can be configured to be not directly attached to the remainder of the tower. For example, the tower cover 36 can be resting freely on or attached to the base cover 34.

The fasteners 70 can be snaps. The fasteners 70 can be a latch and the associated ports or catches.

FIGS. 34 through 63 illustrate variations of the fasteners 70 that can secure the body cover 24 to itself, one section of the body cover 24 to another section of the body cover 24, or the head cover 22 to the uncovered heater 2 (e.g., at the heater head 6). For illustrative clarity, the elements fastened by the fasteners 70 are referred to, infra, generically as a first panel 106 and a second panel 108.

Variations of fasteners 70 can include one or more quick release fasteners 70, for example, ¼-turn DZUS fasteners 70 with a retainer and a clip-on receptacle, and/or flat rivet-on receptacle, and/or ultrasonic receptacle (e.g., for thermoplastics), and/or a snap-in receptacle; cam locks (e.g., a "Z" lock), spring-loaded captive plungers and fasteners 70, locking pins 110 with detents (e.g., DZUS), and nylatch 1 and 2-piece DZUS panel fasteners 70, one or more latches (e.g., low profile latches), for example, rotary action draw latches, cam latches, spring-loaded self-adjusting latches, adjustable pull draw latches, rotary draw latches, flexible handle latches, soft-draw latches, over-center draw latches, pop-out knob latches, swell action latches, and flush compression latches; magnets, one or more snaps; one or more pieces of hook and loop tape (e.g., Velcro); one or more pieces of interlocking stem and head tape (e.g., Dual Lock from 3M Corporation of Minneapolis, Minn.) (i.e., wherein one piece of hook and loop or stem and head tape comprises at least two opposed sheets that are configured to interlock with one another); one or more taped joints (e.g., for closure and cosmetics); one or more self-locking implanted cotter ("SLIC") pins; one or more ties, for example, nylatch cable clamps, tie straps, cable ties, and elastic ties; one or more clips, for example, fold clips; and trim retainers labels; one or more laces; one or more magnetic catches; one or more channel moldings; one or more removable hinges 64; and combinations thereof.

Figure 34:
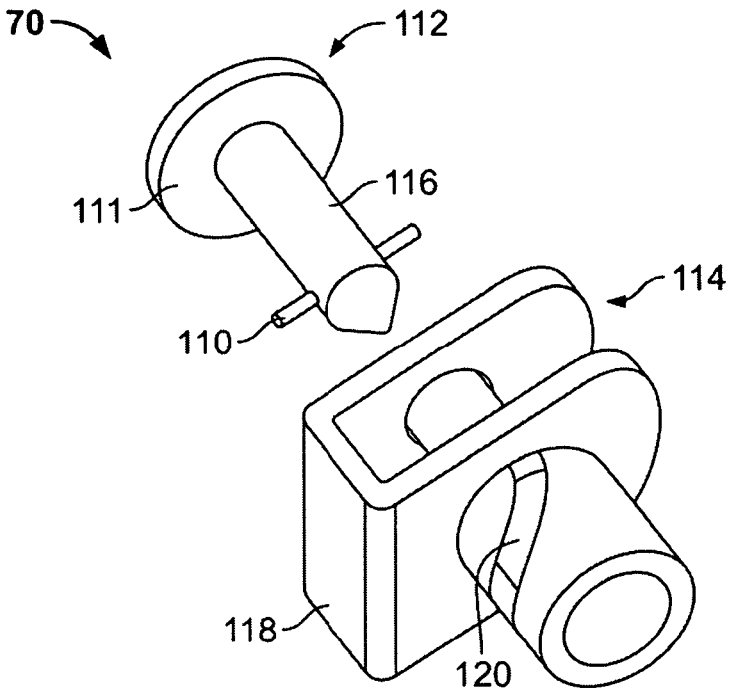
FIG. 34 illustrates a variation of a fastener in an unfastened configuration.

FIG. 34 illustrates that the fastener 70 can have a male cam lock 112 and a female cam lock 114. The male cam lock 112 can have a shaft head 111 and shaft 116. The male cam lock 112 can have a locking pin 110 traversing and extending substantially perpendicularly from the shaft 116. The female cam lock 114 can be configured to receive the shaft 116. The female cam lock 114 can have a bracket 118. The female cam lock 114 can have a channel 120 configured to receive and removably attach to the locking pin 110.

Figure 35:
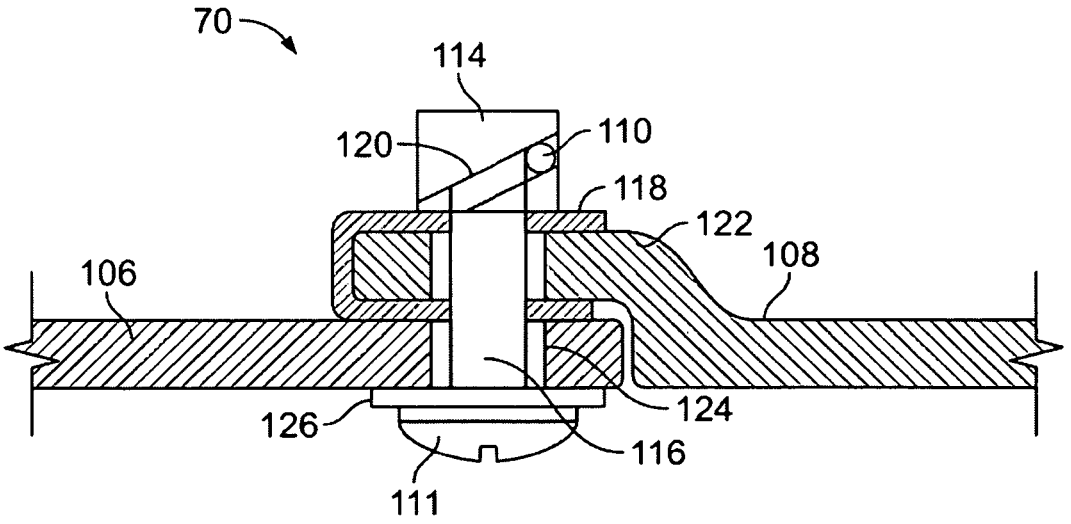
FIG. 35 illustrates a variation of a method for using the fastener of FIG. 34.

FIG. 35 illustrates that the second panel 108 can be configured to have a raised or lowered lip 122 to fit the first panel 106. The first panel 106 and the second panel 108, for example in the lip 122, can have a fastener port 124. The fastener port 124 can align to form a single channel. The bracket 118 of the female cam lock 114 can be fixedly or removably attached to the end of the lip 122. The shaft 116 can be inserted through the fastener port 124. The shaft 116 can be inserted through a rubber washer 126 between the shaft head 111 and the first panel 106. The shaft head 111 can be driven by a screwdriver or directly by hand. The shaft 116 can be rotated to slide the locking pin 110 through the locking pin channel 120. The fastener 70 can releasably attach the first panel 106 to the second panel 108.

Figure 36:
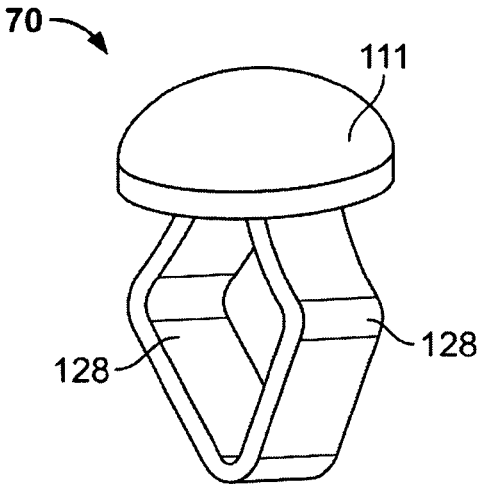
FIGS. 36 and 37 illustrate variations of a fastener.

FIG. 36 illustrates that the fastener 70 can be a one-piece rivet. The rivet can have a shaft head 111. The rivet can have resilient legs 128 extending longitudinally and radially from the shaft head 111. The legs 128 can be integral to the other legs 128 and the shaft head 111.

Figure 37:
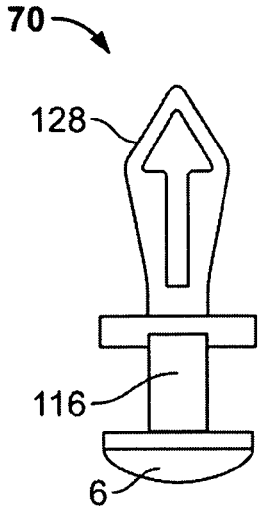

FIG. 37 illustrates that the fastener 70 can be a two-piece clinch retainer. The shaft head 111 and shaft 116 can be slidably attached to the legs 128. The legs 128 can be configured to radially expand when the shaft 116 is translated toward the legs 128.

Figure 38:
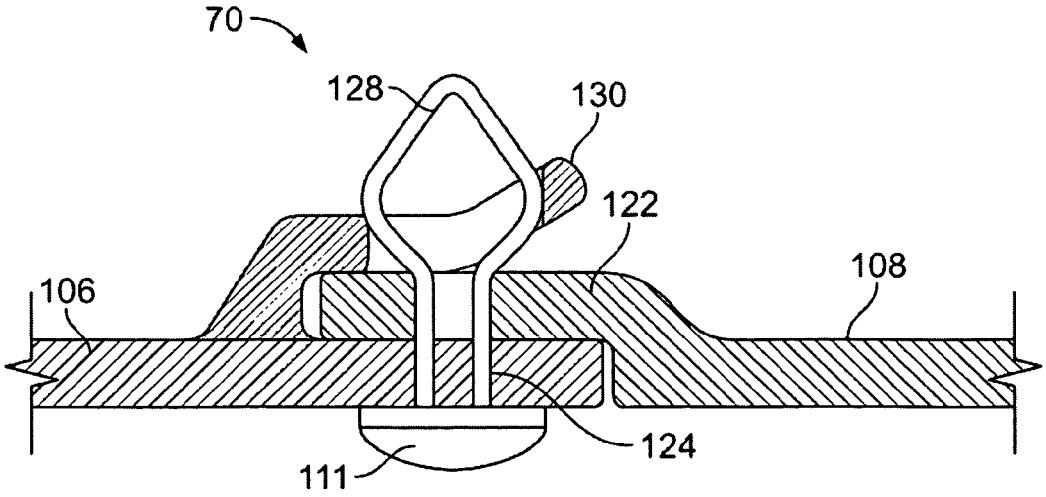
FIG. 38 illustrates a variation of a method for using the fastener of FIG. 36.

FIG. 38 illustrates that the rivet can be inserted through the fastener port 124. The legs 128 can radially expand on the opposite side of the panels from the shaft head 111. The first 106 and/or second panel 108 can have a flange 130 to bracket the other panel.

Figure 39:
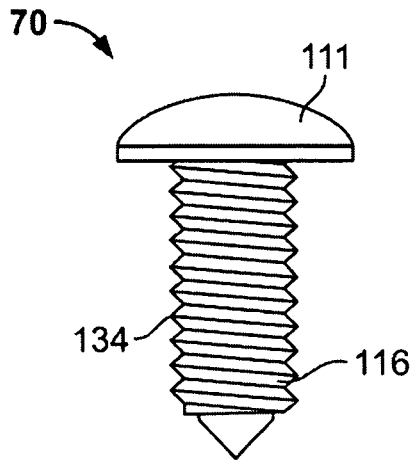
FIG. 39 illustrates a variation of a fastener.

FIG. 39 illustrates that the fastener 70 can be a screw. For example, the fastener 70 can be a wood screw or similar to a wood screw. The fastener 70 can have a shaft head 111, shaft 116 and thread 132, a spring or resilient hoops, Christmas tree retainers 134, or combinations thereof extending from the shaft 116. The thread 132, spring, or hoops can have a larger radius than the fastener port 124. The thread 132, spring or hoops can be forced through the fastener port 124 and interference fit with the fastener port 124 when deployed to attach to the fastener port 124. The fastener 70 can be made from stainless steel.

The shaft 116 of the variation of the fastener 70 of FIG. 39 can be inserted through the first panel 106 and the second panel 108. The shaft 116 can then be secured by a nut, nut insert, or clip (for example, similar to the fastener 70 shown in FIG. 40, with a central channel through the fastener 70 of FIG. 40 where the central channel is configured to receive the shaft 116 of the fastener 70 of FIG. 39) on the opposite side of the panels 106 and 108 from the head 111.

The shaft 116 can be inserted through ports in the first panel 106 and/or the second panel 108, and/or the shaft 116 can bore through the first panel 106 and/or the second panel 108. The shaft 116 can be oriented at a perpendicular, near perpendicular or slight perpendicular angle to the seam 48.

In one variation, three fasteners 70 can be used on each side of the body cover 24 (i.e., six total fasteners), for example one near the top of the body cover 24, one near the middle of the body cover 24, and one near the bottom of the body cover 24.

Figure 40:
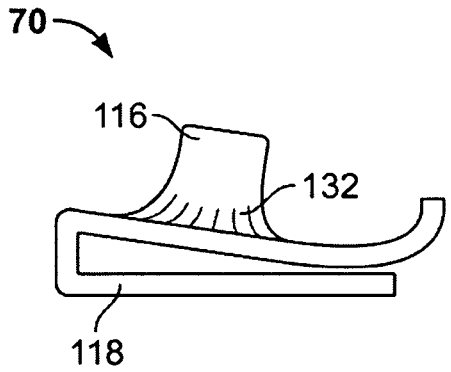
FIG. 40 illustrates a variation of a fastener second element.

FIG. 40 illustrates that the fastener 70 can have a shaft 116 extending from and integral with a bracket 118. The bracket 118 can be attached to the second panel 108 and the shaft 116 can attach to the fastener port 124 on the first panel 106 (similar to as shown in FIG. 35, but with the shaft 116 integral with the bracket 118). The shaft 116 can have a flat end. The shaft 116 can have threads 132 or fins extending longitudinally (as shown) or helically along the shaft 116. The threads 132 can interference or friction fit into the panel surrounding the fastener port 124 into which the shaft 116 is inserted.

Figure 41:
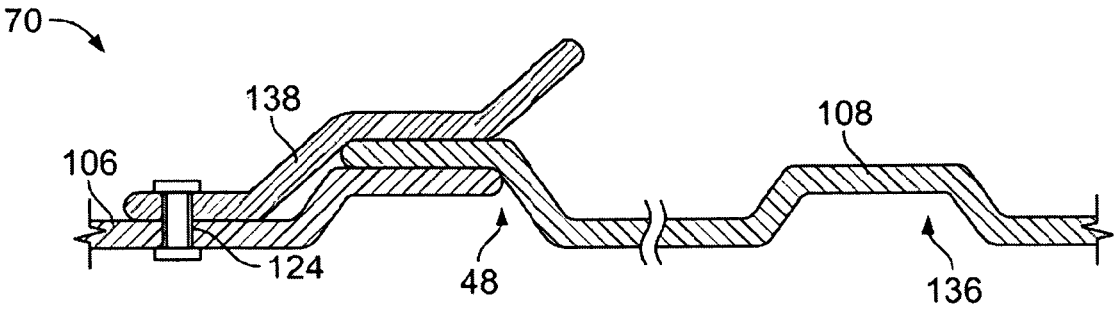
FIG. 41 illustrates a variation of a method for using a fastener.
Figure 42:
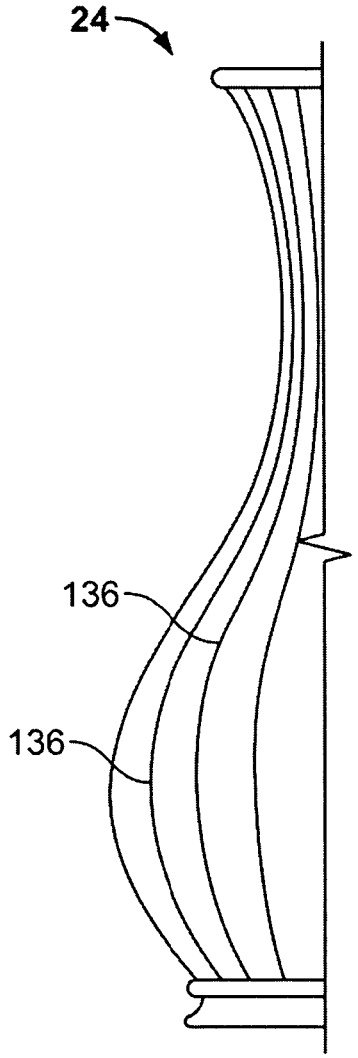
FIG. 42 illustrates a portion of a variation of the body cover showing a fluted surface that can visually obscure or disguise one or more seams.

FIGS. 41 and 42 illustrate that the first 106 and/or second panels 108 can have stepped grooves 136 or fluted. The first panel 106 can have a fastener port 124. The second panel 108 can have a fastener port 124 or be absent any fastener ports 124. The fastener 70 can removably attach a supplemental panel, flange 130, or washer 126 to the first panel 106. The supplemental panel 138 and the first panel 106 can friction fit (e.g., squeeze fit) around the second panel 108. The supplemental panel 138 can be on the inside or outside of the cover. The grooves can obscure the joint or seam 48 or between the first panel 106 and the second panel 108.

Figure 43:
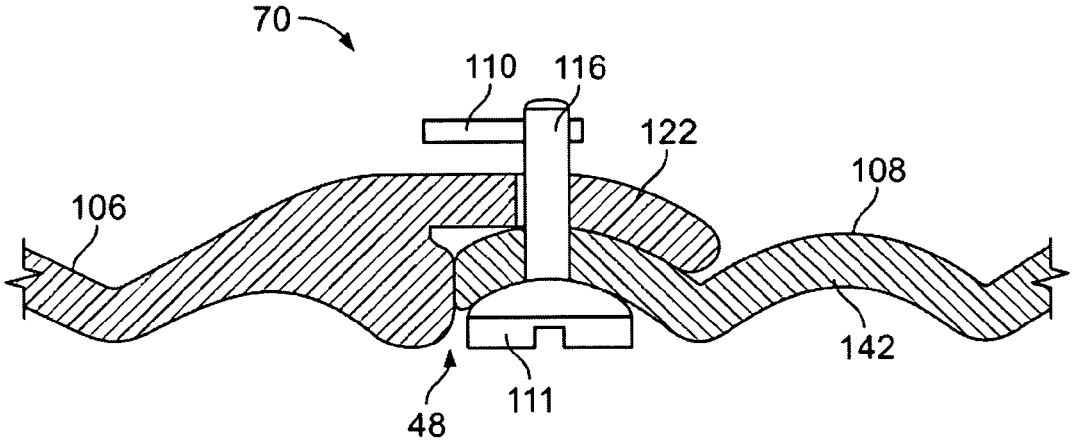
FIG. 43 illustrates a variation of a method for using a fastener.

FIG. 43 illustrates that the first 106 and/or second panel 108 can have one or more rounded grooves 142. The fastener 70 can have a shaft 116 extending from the shaft head 111. A locking pin 110 can be inserted transversely through the shaft 116 on the opposite side of the panels from the shaft head 111.

Figure 44:
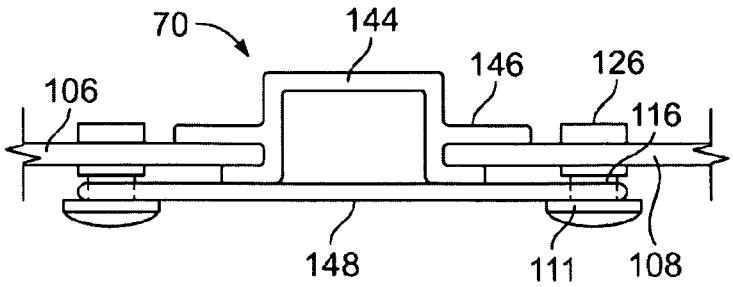
FIG. 44 illustrates a variation of a method for using a fastener.
Figure 45:
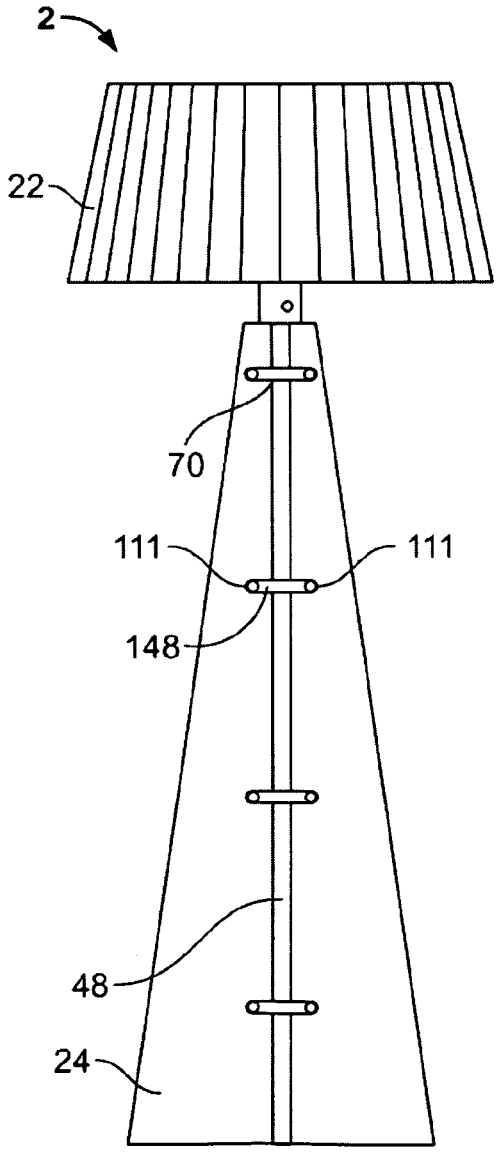
FIG. 45 illustrates a portion of a variation of the body cover closed using the fasteners of FIG. 44.

FIGS. 44 and 45 illustrate that one or more spacers 144 can be placed in the joint or seam 48 between the panels. The spacer 144 can have spacer brackets 146 configured to seat the ends of the panels. One or more rigid or flexible straps or ties 148 can be attached to both panels, for example, to hold the panels in tension. The ties 148 can be attached to the panels with a screw, brad or pin, for example having a shaft 116 extending from the shaft head 111. A washer 126 can be attached to the end of the shaft 116 on the opposite side of the panel from the shaft head 111. As shown in FIG. 45, the tie 148 can be placed on the outside or the inside of the cover.

Figure 46:
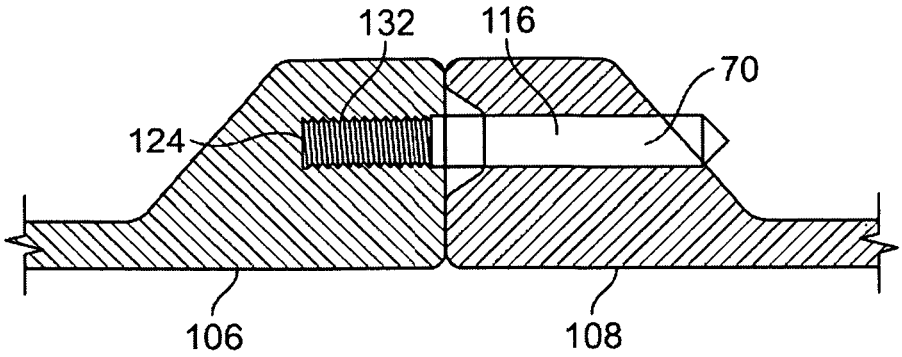
FIGS. 46 and 47 illustrate a variation of a method for using a fastener.

FIG. 46 illustrates that the fastener port 124 can be substantially parallel to the outer or inner surface of the panels. The fastener 70 can have a shaft 116 having a threaded end 132. Part or all of the length of the fastener port 124 can be threaded 132. The fastener 70 can be inserted and screwed into the fastener port 124.

Figure 47:
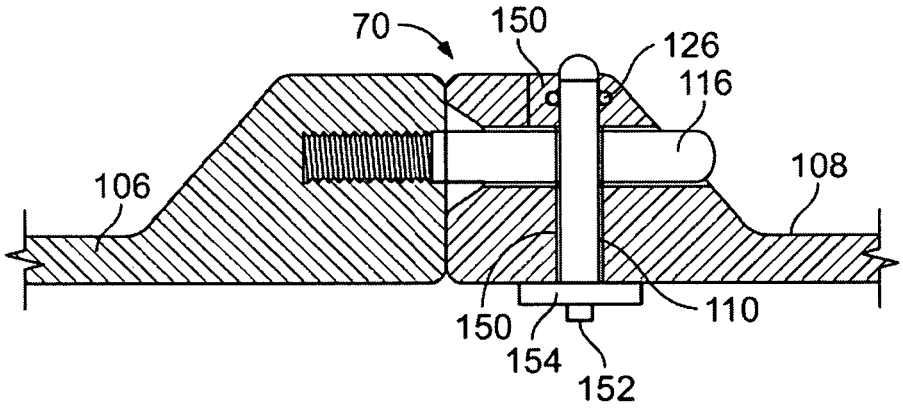

FIG. 47 illustrates a similar variation to FIG. 44, but with a locking pin 110 inserted through the shaft 116. The locking pin 110 can be inserted through a locking pin port 150 in the second panel 108. The locking pin 110 can be inserted transversely through a port in the shaft 116. A washer 126, nut or lockwasher can be attached to the locking pin 110 on the opposite side of the shaft 116 from the locking pin head 152. The locking pin head 152 can have a detent 154. The shaft 116 can align the first panel 106 and the second panel 108.

Figure 48:
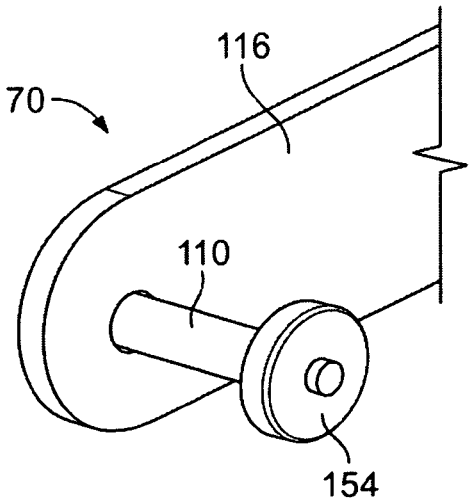
FIG. 48 illustrates a perspective view of a variation of FIG. 47.

FIG. 48 illustrates one end of a variation of the assembled fastener 70 of FIG. 47. FIG. 48 illustrates that the shaft 116 can be a flat plate. The shaft 116 can be substantially cylindrical.

Figure 49:
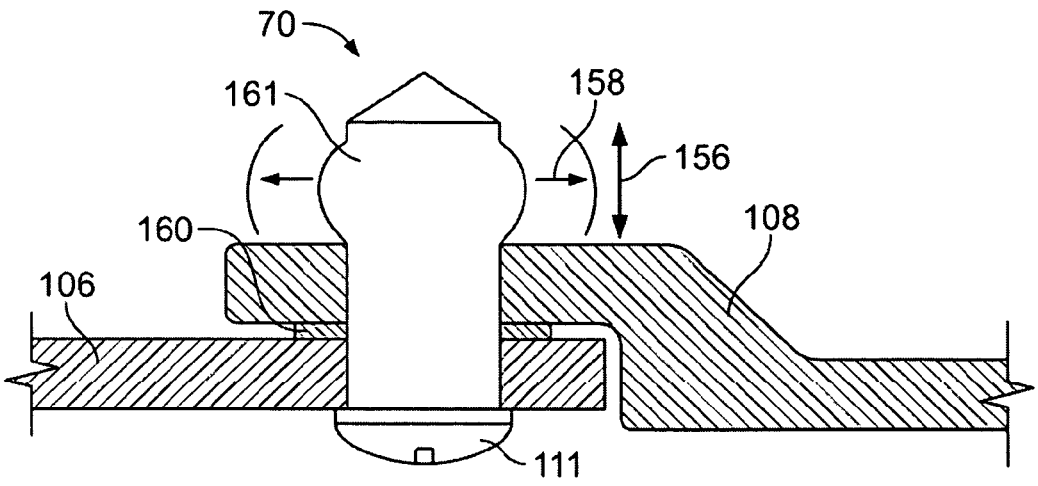
FIGS. 49 and 50 are top and side views, respectively, of a variation of a method of using a fastener.
Figure 50:
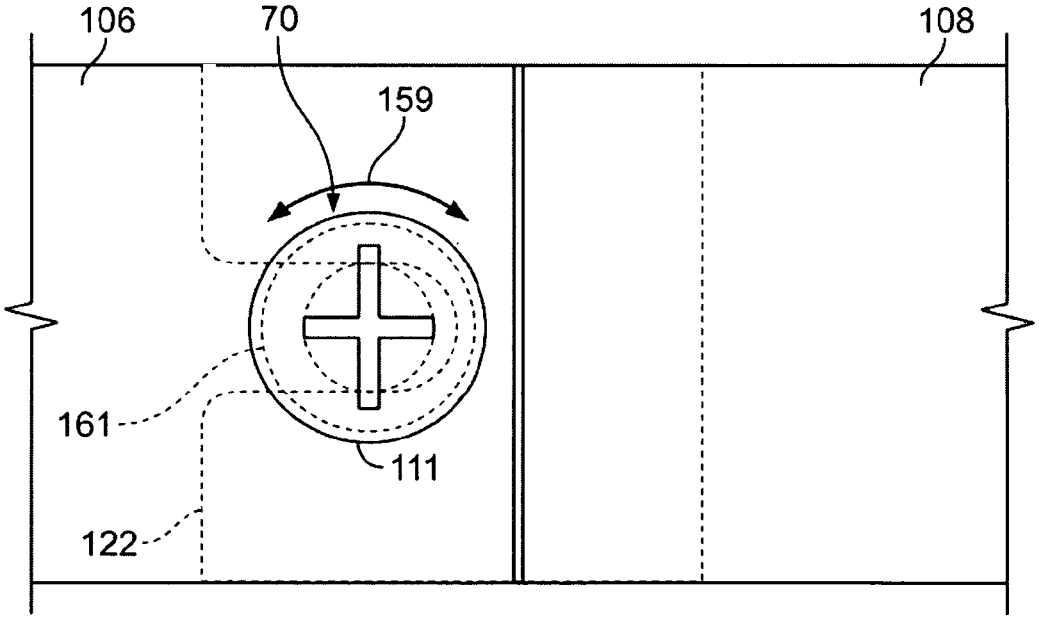

FIG. 49 illustrates that the fastener 70 can be a multi-piece cam fastener 70. The cam fastener 70 can have a head element rotatably attached to a body element. The cam fastener 70 can be inserted 156 through the fastener port 124. An internal cam (not shown for illustrative clarity) can cause the body 4 to radially expand, as shown by arrows 158 in FIG. 49, when the shaft head 111 is rotated, as shown by arrows 159 in FIG. 50, with respect to the to the shaft body 161.

A retainer clip 160 can be attached to or integral with the shaft body 161 and/or placed between the first panel 106 and the second panel 108 and the fastener 70 can be inserted through the retainer clip 160.

Figure 51:
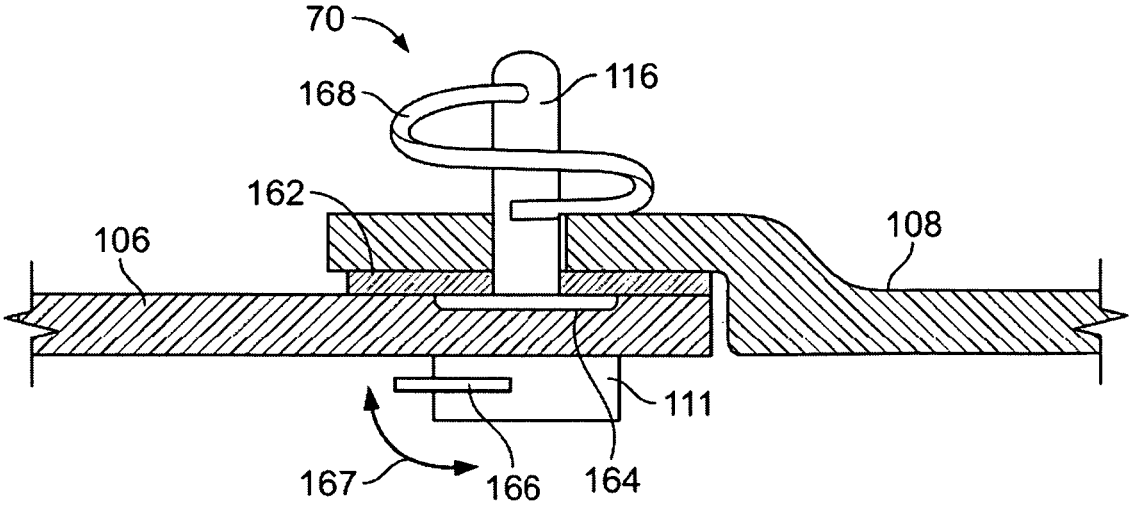
FIGS. 51 and 52 are top and side views, respectively, of a variation of a method of using a fastener.
Figure 52:
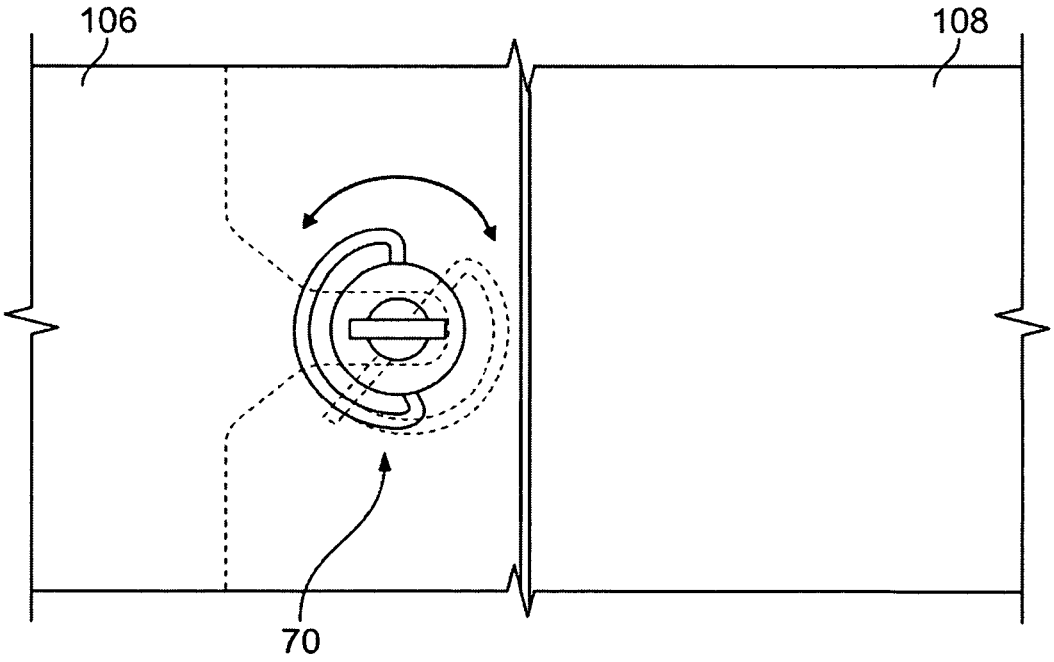

FIGS. 51 and 52 illustrate that a friction strip 162 and/or a retainer ring 164 can be between the first panel 106 and the second panel 108. The friction strip 162 can minimize slipping between the first panel 106 and the second panel 108.

The fastener 70 can have a handle 166 rotatably attached to the shaft head 111. The handle 166 can be used to rotate and push and pull the fastener 70 directly by hand. The handle 166 can be rotated, as shown by arrows 167 in FIG. 51, out for use and in for a low profile.

The shaft 116 can be attached to or integral with a spring 168. The spring 168 can slidably rest against the side of the second panel 108. The shaft 116 can have threads 132. The shaft 116 can be threadably attached to the first panel 106, and/or second panel 108, and/or the retainer ring 164. The shaft 116 can be rotated, for example, screwing the shaft 116 to increase compression of the spring 168 between the end of the shaft 116 and the second panel 108. FIG. 41 shows the handle 166 in a first configuration, and a second, phantom, configuration after rotation.

Figure 53:
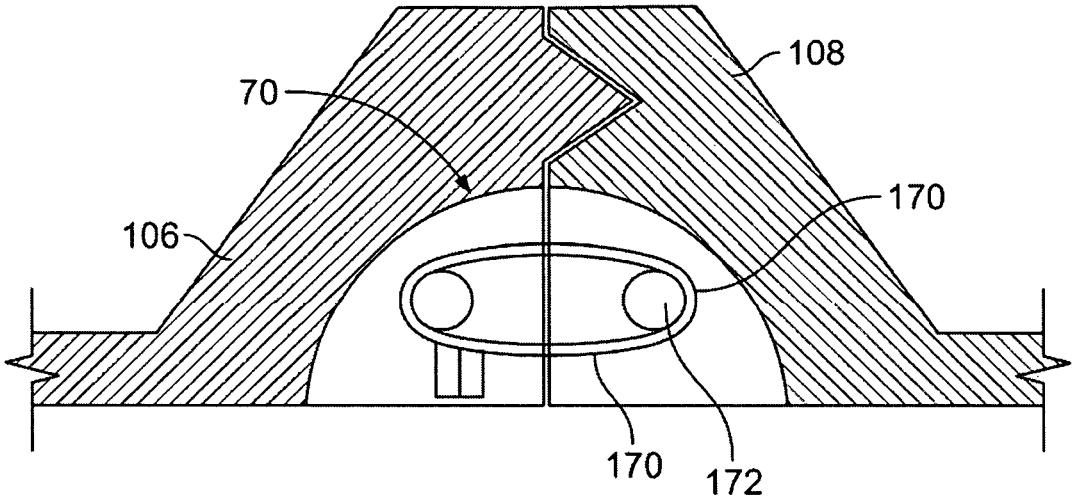
FIGS. 53 and 54 are top and side views, respectively, of a variation of a method of using a fastener.
Figure 54:
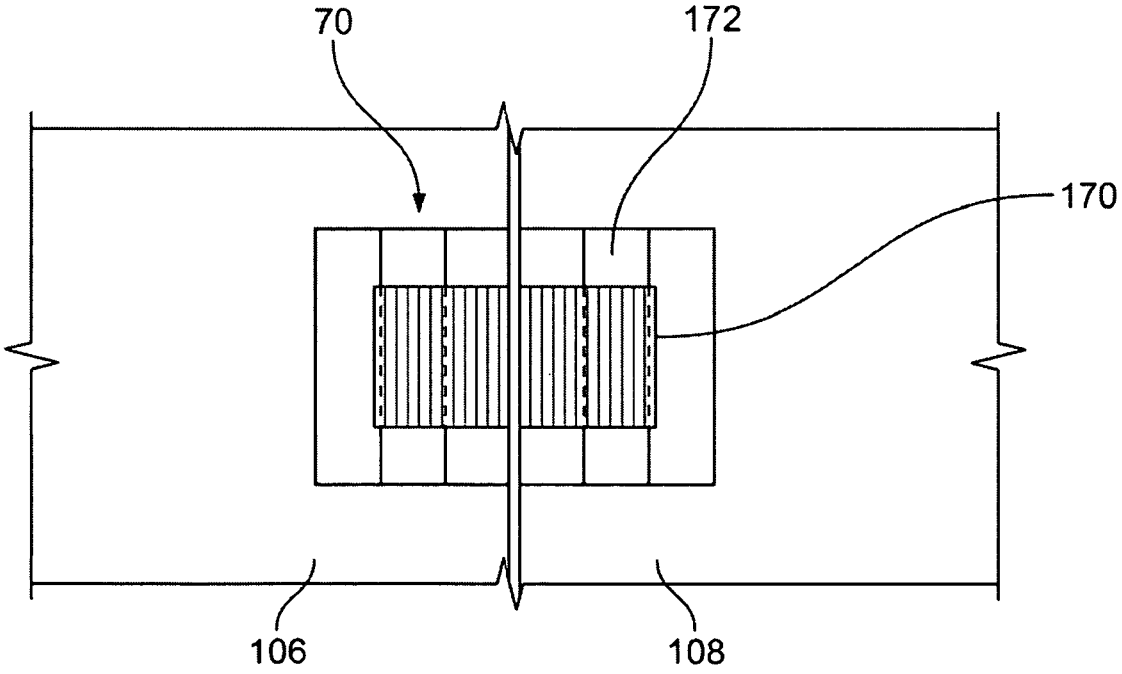

FIGS. 52 and 53 illustrate that the fastener 70 can be a rigid or flexible strap 170, strip or clamp. The strap 170 can be attached to a pin 172 on each panel. The strap 170 can be wrapped around the pins 172, as shown.

Figure 55:
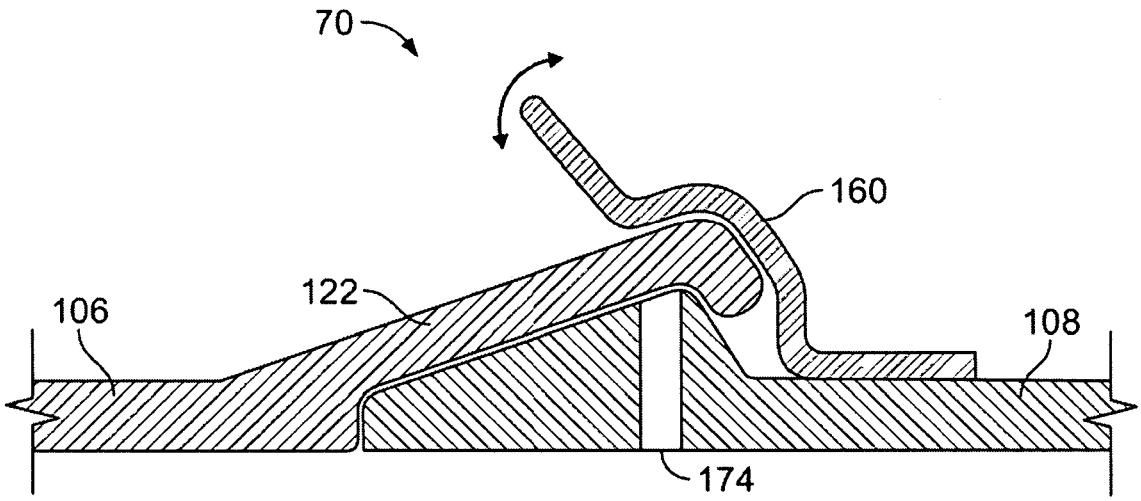
FIGS. 55 through 59 each illustrate variations of methods using variations of the fastener.
Figure 56:
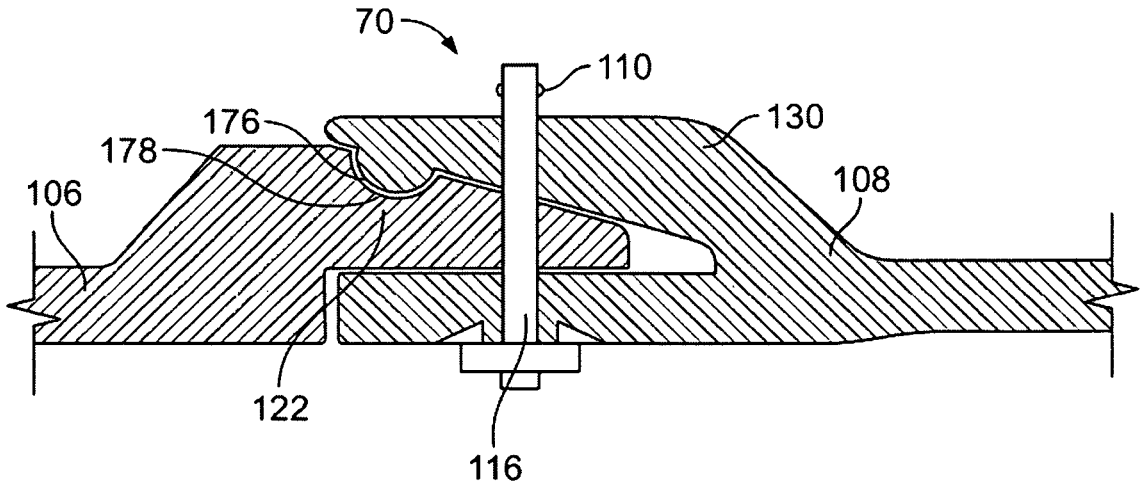

FIGS. 55 and 56 illustrate that the second panel 108 can be attached to or integral with a supplemental panel or retainer clip 160. The retainer clip 160 can be metal (e.g., steel or aluminum, wherein the metal can have a raw finish or be powder coated) or resilient plastic. The retainer clip 160 can be biased toward a closed position. (FIG. 44 illustrates the retainer clip 160 in a partially open position.) The retainer clip 160 can close onto, and friction and/or interference fit against the lip 122 of the first panel 106. The second panel 108 can have a prod port 174, for example to insert a prod, shaft 116 or other object, to bend the retainer clip 160 away from the first panel 106 and release the first panel 106 from the second panel 108.

FIG. 56 illustrates that second panel 108 can have a flange 130. The flange 130 can have a tongue 176 extending therefrom. The tongue 176 can be attachably received by a groove 178 on the lip 122 of the first panel 106.

Figure 57:
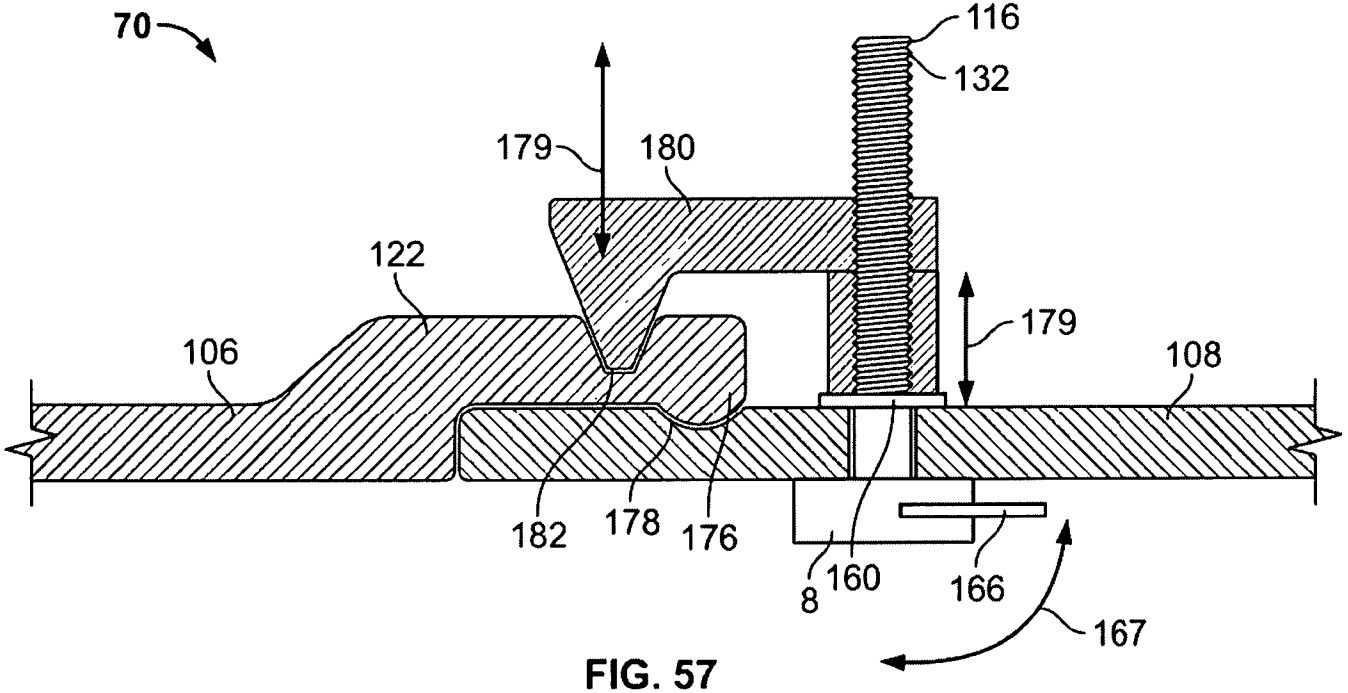
Figure 58:
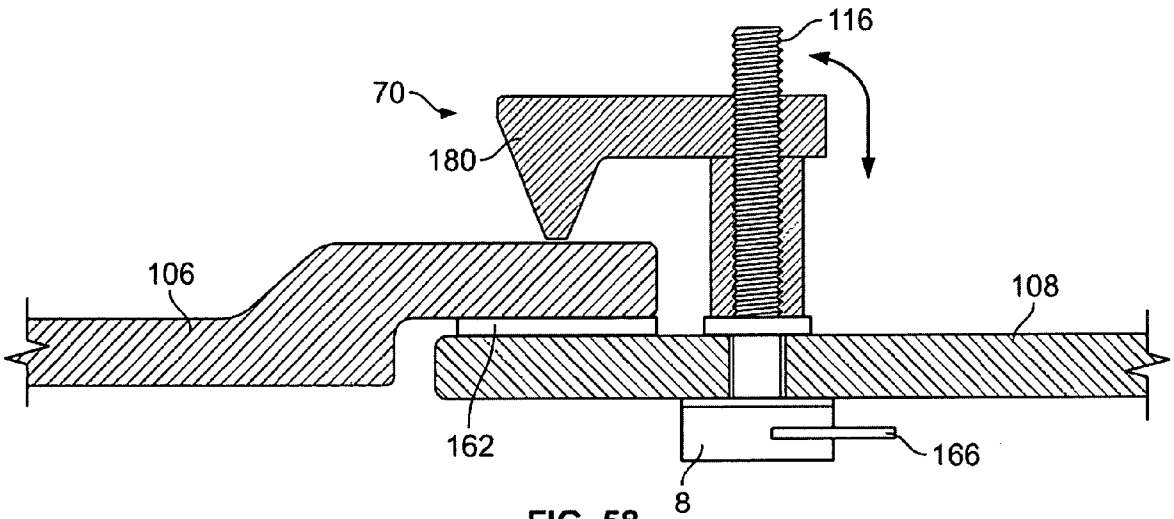

FIG. 57 illustrates that the fastener 70 can have a retainer clamp 180. A base 8 or shaft head 111 with a shaft 116 can extend from the retainer clamp 180. The base 8 and shaft 116 can be rotatably attached to the second panel 108, for example through a fastener 70 port. The shaft 116 can have threads 132. A clamp 180 or vice can be threadably attached to the shaft 116. The handle 166 can be rotated, as shown by arrows 167, causing the clamp 180 to press down (or release upward), as shown by arrows 179, toward (or away from) the base 8 on the first panel 106. The clamp 180 can be seated in the first panel 106 in a clamp seat 182. FIG. 58 illustrates a variation similar to that of FIG. 57, but with a friction strip 162, skin, or molding between the first panel 106 and the second panel 108.

Figure 59:
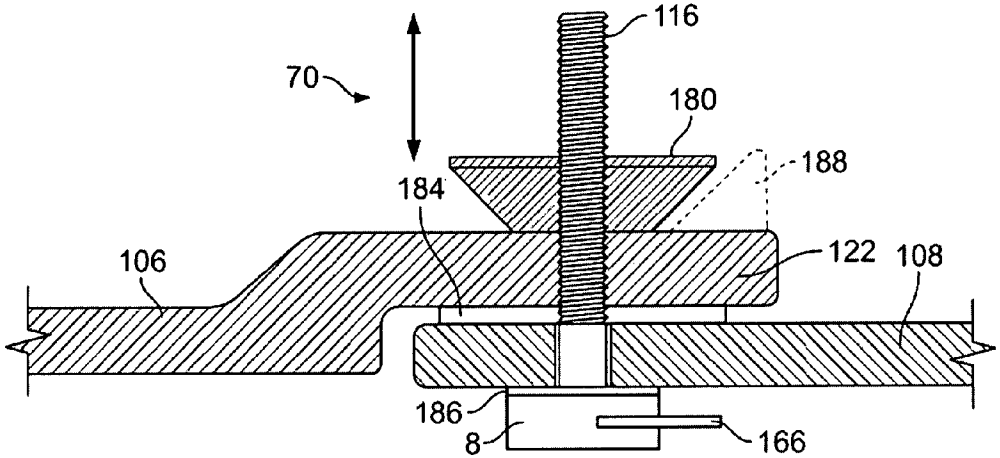

FIG. 59 illustrates that the shaft 116 can be inserted through the first panel 106 and the second panel 108. A first friction strip 184 can be placed between the first panel 106 and the second panel 108. A second friction strip 186, lock washer, friction ring, or combinations thereof, can be placed between the base 8 or shaft head 111 and the second panel 108. A clamp guide 188 can be integral with or attached to the first panel 106.

Figure 60:
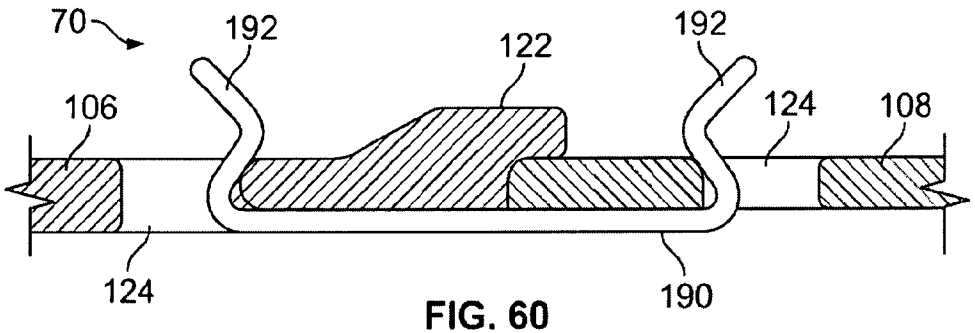
FIGS. 60 and 61 are top and side views, respectively, of a variation of a method of using a fastener.
Figure 61:
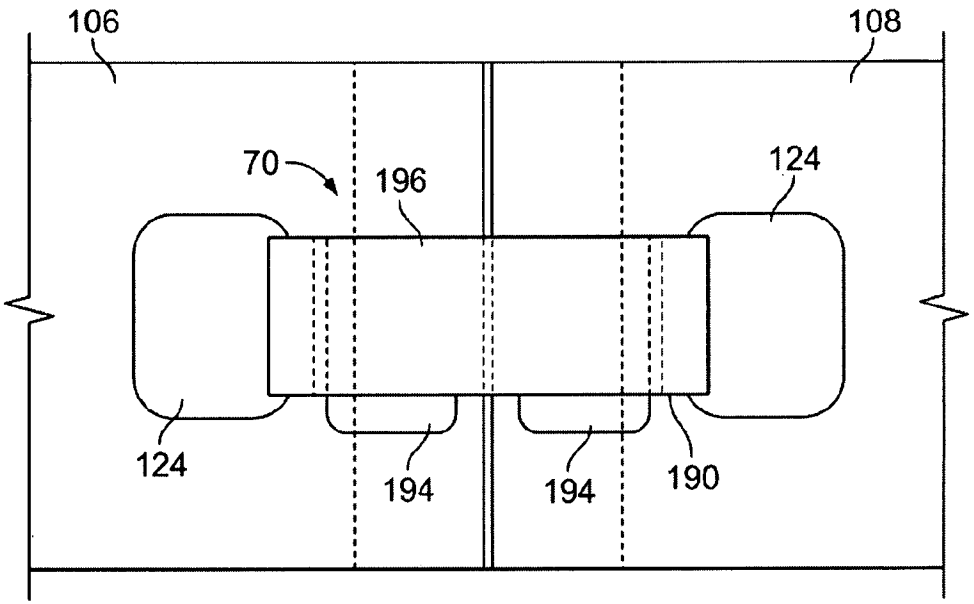

FIGS. 60 and 61 illustrate that the fastener 70 can be a resilient clip 190. The clip 190, or any other fastener, can be made from metal (e.g., steel or aluminum, wherein the metal can have a raw finish or be powder coated), polymer (e.g., polyethylene (PE)), or a combination thereof. The fastener port 124 on the first panel 106 can be non-overlapping with the fastener port 124 on the second panel 108. The clip 190 can have two clip legs 192. Each clip leg 192 can be inserted through a fastener port 124. The clip 190 can hold the first panel 106 and the second panel 108 together in tension. The one, two or more holds 194 can extend from the clip 190. The holds 194 can be used, for example by grabbing with a fingernail, key or screwdriver, to assist in removal of the clip 190. The clip 190 can have a clip face 196. Information (e.g., branding, advertising, serialization information for the clip 190) can be printed or attached to the clip face 196.

Figure 62:
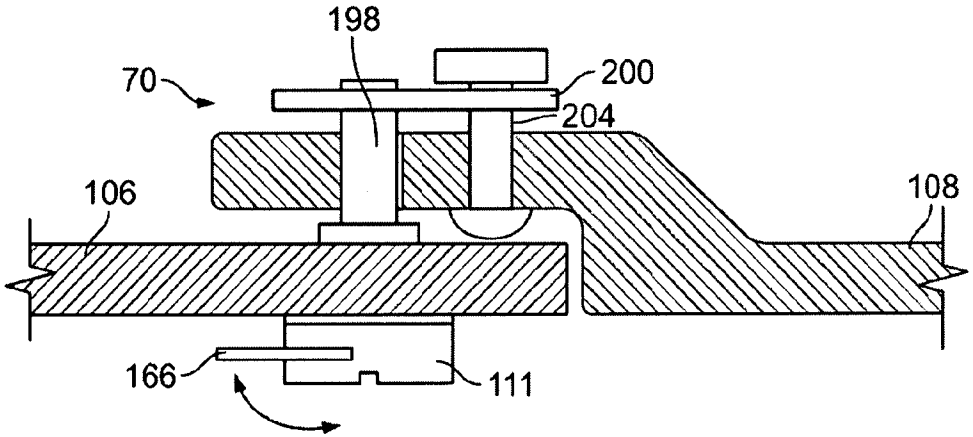
FIGS. 62 and 63 are top and side views, respectively, of a variation of a method of using a fastener.
Figure 63:
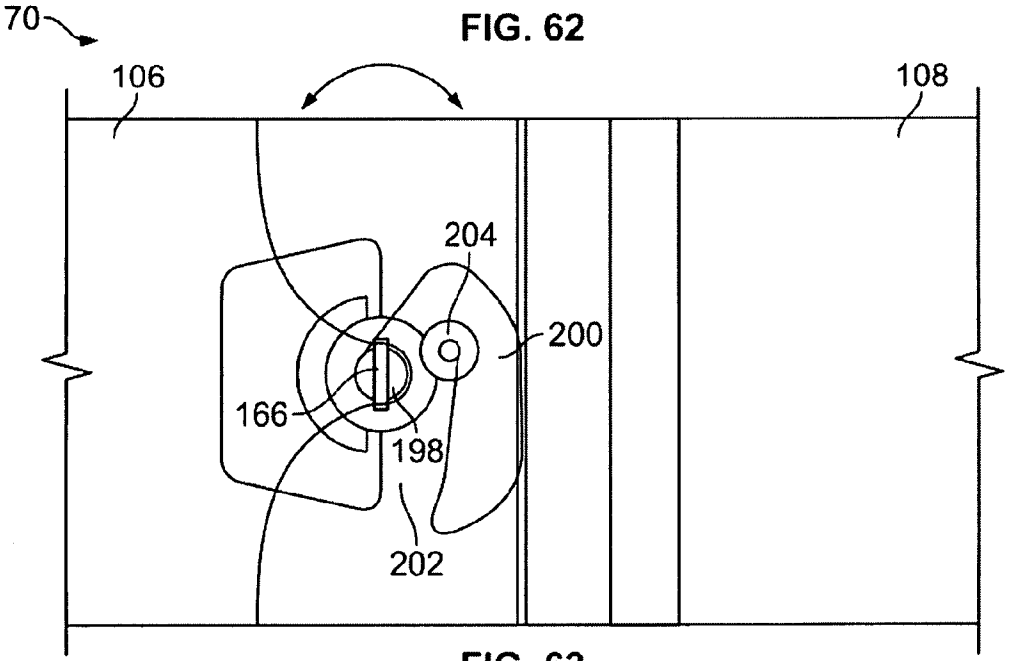

FIGS. 62 and 63 illustrate that the fastener 70 can be a draw latch. The fastener 70 can have a pivot pin 198 fixedly attached to the shaft head 111 and handle 166 on one side of the first panel 106, and to a latch plate 200 on the other side of the second panel 108. When the handle 166 is rotated, as shown by arrows in FIG. 52, the latch plate 200 rotates, as shown by arrows in FIG. 63. The latch plate 200 can have a latch slot 202. The outer edge of the latch slot 202 can have a decreasing radius with respect to the angle around the latch plate 200 as measured from the pivot pin 198. The second panel 106 can be fixedly attached to a latch pin 204. The latch pin 204 can be received by the latch slot 202. With the latch pin 204 in the latch slot 202, to six the first panel 106 to the second panel 108, the latch plate 200 can be rotated so the latch pin 204 is frictionally fit to the edge of the latch slot 202. To detach the latch pin 204 from the latch plate 200, the direction of rotation of the latch plate 200 is reversed.

The body cover 24, head cover 22, fasteners 70, or other elements described herein can be made from thermoplastics (e.g., Polyethylene terephthalate (PET), Polyethylene (PE), Polypropylene (PP), including those used in rotational or blow molding) one or more fiber-reinforced polymers (e.g., FRP, fiberglass), resin, sheet metal (e.g., stamped sheet metal), urethane, heat resistant fabrics (e.g., stretched around a steel frame or other structure), or combinations thereof. Any metal used can be steel or aluminum. The metal can have a raw or brushed finish or be powder coated. The body cover 24, head cover 22, fasteners 70, or combinations thereof can be formed by being rolled or molded, for example roto-molded.

The cover can have a smooth or textured finish. The cover can be lightweight, suited for indoor or outdoor use, long lasting, and have a durable finish. The outer surface of the cover can be anodized, polished, lacquered, powder coated (e.g., with electrostatic paint), or combinations thereof. The cover can be simply and repeatedly assembled and disassembled, and easily transported from location to location. Covers can be stored by nesting the covers together or telescoping each other. The covers can have fluting, appliqués, wrapped in vinyl, self-adhesive tape and combinations thereof, for example to obscure the appearance of joints 38 or seams 48 or for advertising.

The cover can be punctured, louvered, folded, or combinations thereof. The cover can have metal mesh. The cover can be treated to dissipate or be insulated from heat.

The head cover 22 can have, for example, 3 to 6 straps bridging the gap between the head cover 22 periphery and the center of the heater 2, (e.g., like radial spokes) and attaching to where the heat shield joins the tower 10 or heater head 6. Attachment of the head cover 22 to the heater head 6 or tower 10 can be accomplished with a mechanical quick-release fastener 70 to new or existing attachment points. The head cover 22 can be attached via a thermal insulator and/or height spacers 144.

The heater cover can have one or more lights inside and/or outside of the heater cover.

PCT Application No. PCT/US2008/074085, filed Aug. 22, 2008 is incorporated herein in its entirety.

It is apparent to one skilled in the art that various changes and modifications can be made to this disclosure, and equivalents employed, without departing from the spirit and scope of the invention. Elements and characteristics shown with any variation are exemplary for the specific variation and can be used in combination with elements or characteristics from other variations within this disclosure.

I claim:

1. A heater comprising:

a tower;

a head at the top of the tower, wherein the head comprises a heating element and a heat shield;

a head cover coupled to the head, wherein the head cover has a first opening and a second opening with a body portion positioned therebetween, wherein the first opening is in fluid communication with the second opening;

wherein the head cover at least partially surrounds the heat shield, wherein the head cover provides a solid enclosure and energy emitted from the heat element reflects off of the head cover;

a base coupled to the tower;

a tower cover coupled to the tower, wherein the tower cover is capable of being removed; and a base cover moveable from a first position encircling the base to a second position vertically overlapping the tower cover.

2. The heater of claim 1, wherein the head cover is removably attached to the head.

3. The heater of claim 1, wherein the head cover obscures the heating element from view.

4. The heater of claim 1, further comprising a lighting element.

5. The heater of claim 4, wherein the lighting element is radially inside the base cover.

6. The heater of claim 4, wherein the lighting element is radially inside the tower cover.

7. The heater of claim 4, wherein the lighting element is radially inside the head cover.

8. The heater of claim 4, wherein the lighting element comprises an electric light.

9. The heater of claim 1, further comprising an acoustic speaker.

10. The heater of claim 1, further comprising a seam between the tower cover and the base cover when the base cover is in the first position.

11. A heater comprising:

a tower;

a head at the top of the tower, wherein the head comprises a heating element and a heat shield;

a head cover coupled to the head, wherein the head cover has a first opening and a second opening with a body portion positioned therebetween, wherein the first opening is in fluid communication with the second opening;

wherein the head cover at least partially surrounds the heat shield, wherein the head cover provides a solid enclosure and energy emitted from the heating element reflects off of the head cover; and a body cover removably attached to the tower;

wherein the body cover comprises a body cover first section and a body cover second section, and wherein the body cover first section is rotatably attached to the body cover second section.

12. The heater of claim 11, wherein the body cover first section is rigid.

13. The heater of claim 12, wherein the body cover second section is rigid.

14. The heater of claim 11, wherein the body cover comprises a hinge attached to the body cover first section and the body cover second section.

15. The heater of claim 11, wherein the head cover is removably attachable to the head, and wherein the head cover comprises a head cover first section mechanically attached to a head cover second section.

16. The heater of claim 11, further comprising an acoustic speaker.

17. The heater of claim 11, wherein the body cover comprises a fastener first element, and wherein the head comprises a fastener second element, and wherein the fastener first element is configured to removably attach to the fastener second element.

18. The heater of claim 17, wherein the fastener second element comprises a fastener port, and wherein the fastener port comprises a port in the cover.

19. A heater comprising:

a tower;

a head at the top of the tower, wherein the head comprises a heating element and a heat shield;

a head cover coupled to the head, wherein the head cover has a first opening and a second opening with a body portion positioned therebetween, wherein the first opening is in fluid communication with the second opening;

wherein the head cover at least partially surrounds the heat shield, wherein the head cover provides a solid enclosure and energy emitted from the heating element reflects off of the head cover;

a body cover removably attached to the tower, wherein the body cover has a seam; and a fastener;

wherein the body cover is resilient and wherein the body cover surrounds the tower, and wherein the fastener removably attaches a first side of the seam to a second side of the seam.

20. The heater of claim 1, wherein the head cover comprises multiple openings in the head cover.

21. The heater of claim 1, wherein the tower comprises a first segment coupled to a second segment, wherein the first segment is rotatable relative to the second segment to allow movement of the head.

22. The heater of claim 1, further comprising an advertisement located on the heater.

23. The heater of claim 1, wherein the heater comprises two or more heads.

24. The heater of claim 11, further comprising an air gap between the head cover and the heat shield.

25. The heater of claim 11, further comprising at least one fastener coupling the head cover to the head.

26. The heater of claim 11, wherein at least a portion of the head cover is positioned vertically lower than the heat shield.

* * * * *